US008534867B1

(12) United States Patent
Beadle

(10) Patent No.: US 8,534,867 B1
(45) Date of Patent: Sep. 17, 2013

(54) LED LIGHT MODULES AND OUTDOOR LIGHT FIXTURES INCORPORATING SUCH LIGHT MODULES

(75) Inventor: Joshua Z. Beadle, San Diego, CA (US)

(73) Assignee: Hunter Industries Incorporated, San Marcos, CA (US)

( * ) Notice: Subject to any disclaimer, the term of this patent is extended or adjusted under 35 U.S.C. 154(b) by 775 days.

(21) Appl. No.: 12/633,741

(22) Filed: Dec. 8, 2009

Related U.S. Application Data

(60) Provisional application No. 61/120,489, filed on Dec. 8, 2008, provisional application No. 61/151,201, filed on Feb. 10, 2009.

(51) Int. Cl.
*F21V 17/06* (2006.01)
*F21V 17/00* (2006.01)

(52) U.S. Cl.
CPC ..... *F21V 17/002* (2013.01)
USPC ..... 362/235; 362/249.02; 362/296.08; 362/311.02; 362/153.1

(58) Field of Classification Search
USPC ..... 362/235, 646, 249.02, 296, 8, 311.02, 362/346, 153, 153.1, 431
See application file for complete search history.

(56) References Cited

U.S. PATENT DOCUMENTS 6,357,892 B1 3/2002 Beadle
6,361,993 B1 3/2002 Beraud
6,422,717 B1 7/2002 Beadle
6,491,407 B1 12/2002 Beadle
6,523,982 B1 2/2003 Haddad
6,612,720 B1 9/2003 Beadle
6,799,869 B1 10/2004 Beadle
6,874,905 B1 4/2005 Beadle
7,021,787 B1 4/2006 Kuelbs
7,387,409 B1 6/2008 Beadle
2007/0189019 A1 8/2007 Klipstein
2007/0268707 A1 11/2007 Smester
2008/0231201 A1 9/2008 Higley et al.
2008/0273331 A1 11/2008 Moss et al.
2008/0316764 A1 12/2008 Peters et al.
2009/0116251 A1 5/2009 Harbers et al.
2010/0001662 A1 1/2010 Nelkin et al.

*Primary Examiner* — Sharon Payne

(74) *Attorney, Agent, or Firm* — Eleanor M. Musick; Procopio, Cory, Hargreaves & Savitch LLP

(57) ABSTRACT

A light module for use in a lighting fixture includes a printed circuit board with one or more LED elements and one or more LED drivers. An electrical connector extends from the lower surface of the printed circuit board for attachment to an electrical socket within the fixture. A thermal conductor is attached on the lower surface of the printed circuit board. A reflector array comprises one or more individual parabolic reflectors, where each individual reflector is disposed at a position corresponding to a position of an LED element. Fastening means releasably attach each of the printed circuit board, the thermal conductor and the reflector array to a support surface within the interior cavity of the base. At least one optical element is releasably mounted on top of the reflector array.

29 Claims, 24 Drawing Sheets

LED LIGHT MODULES AND OUTDOOR LIGHT FIXTURES INCORPORATING SUCH LIGHT MODULES

RELATED APPLICATIONS

This application claims the priority of U.S. Provisional Applications No. 61/120,489, filed Dec. 8, 2008 and No. 61/151,201, filed Feb. 10, 2009, both of which are incorporated herein by reference.

FIELD OF THE INVENTION

The invention relates to a light module for use in low voltage outdoor lighting systems and more particularly to a light module having a light emitting diode ("LED") for a light source and driver circuitry located integral to a printed circuit board ("PCB") and optical components including filters and reflectors that are incorporated in the module.

BACKGROUND OF THE INVENTION

Environmental lighting, particularly outdoor lighting, is well known in commercial or public settings such as parks and schools. Such lighting is also popular in residential applications, both to enhance the appearance and safety of the outdoor area and for security, to illuminate dark areas around a building or in a yard which may provide hiding places and unobserved entry points for intruders.

Conventional landscape and outdoor lighting systems include one or more lighting fixtures which are connected to either a 12 V transformer or a standard 120 VAC line. Some lighting fixtures enclose a halogen lamp or incandescent bulb within a housing, and include a reflector assembly and a lens or window within the housing. These fixtures may be used for highlighting features such as trees or statues, i.e., up-lighting or for pathway or ground lighting.

As technology has advanced and "green" technologies have become more cost-efficient to manufacture, LED lighting systems are becoming more popular as replacements for existing lighting systems. LED components use five to ten times less energy than a fluorescent light and produce significantly more lumens for a given input energy level. In addition to the energy savings from lower power consumption in conventional low voltage lighting systems, LEDs are especially important for use in solar-based lighting systems, where energy efficiency is essential to maximize the period of illumination produced by the stored charge in one or more batteries connected to the photovoltaic solar panel. Due to their solid state construction, LED light sources tend to be more durable and have much longer lives than more traditional lighting solutions such as incandescent and fluorescent lighting. LEDs are versatile in their ability to deliver virtually any color light by combining different red, blue and green arrays. LEDs are ecologically desirable since, unlike their fluorescent counterparts, they contain no lead or mercury. These and other benefits associated with LEDs make them attractive replacements for conventional incandescent, halogen and fluorescent light sources in many applications, including outdoor lighting systems.

One drawback of LEDs is that due to the relatively intense light that is generated across a very small surface area, thermal management becomes a major issue. Unless this heat is properly dissipated, the lifespan of the LED may be greatly reduced. To provide heat management, conventional LED light devices often incorporate heat sink components. In some prior art devices, an LED is mounted on a printed circuit board (PCB) which has holes through which solder or metal paste is flowed to conduct heat from the LED to the air or to a metal slug that conducts heat away from the PCB. In addition, driver circuitry is required for providing input voltage to the LED. The driver circuit, which includes integrated circuits (op-amps and/or transistors) resistors, capacitors, diodes and inductors, protects the LEDs from excessive current by pulsing the input voltage. The driver also regulates the light output. The LED driver is frequently configured in a single module as a can or disk with wires extending from it to allow for connection to an input voltage source, e.g., batteries or cable connected to a lighting system transformer, and to the PCB on which the LED is mounted. The LED driver is usually encapsulated in an epoxy potting material to protect the circuitry from harsh environments and moisture. In an outdoor lighting fixture, the LED driver will often be housed within the post or stem of the fixture, at a distance from the LED light device. This tends to make connection of the LED to the driver a challenge, particularly when the LED must be replaced.

Accordingly, placing an LED lighting component with its circuitry inside lighting fixtures and other structures can be daunting with various space constraints, thermal management and electrical incompatibility. As a result, lighting fixtures utilizing LED light sources are not readily available in conventional outdoor lighting systems.

Thus, the need remains for an outdoor light fixture that is attractive, uses an LED lighting component, is easy to manufacture and service, and may be used to retrofit conventional lighting fixtures. The present invention is directed to such a device.

SUMMARY OF THE INVENTION

It is an advantage of the present invention to provide an outdoor light fixture having an LED lighting assembly, where the LED lighting assembly includes an LED component and its related driver circuitry module coupled to a single PCB. Benefits associated with LED lighting assembly described herein include the ability to utilize LED lighting components in pathway lighting fixtures. Furthermore, by placing an LED lighting component and its associated driver circuitry on a single PCB, the lamp assembly may be used to retrofit currently existing pathway light fixtures.

Light output is maximized by combinations of optical elements (filters and diffusers), reflectors and lenses that may be combined with the LED lighting assembly to produce a lighting module that can be incorporated into a new fixture design or retrofitted into existing low power fixtures.

In one aspect of the invention, a light module is provided for use in a lighting fixture having a base with an interior cavity, the light module includes a printed circuit board dimensioned to be received within the interior cavity of the base, the printed circuit board having an upper surface and a lower surface. An array of LED elements is mounted on the upper surface of the printed circuit board along with one or more LED drivers mounted on the upper surface of the printed circuit board in electrical communication with the LED elements. An electrical connector extends from the lower surface of the printed circuit board for attachment to an electrical socket within the fixture. A thermal conductor is disposed on the lower surface of the printed circuit board. A reflector array comprises an integrated array of individual parabolic reflectors, where each individual reflector disposed at a position corresponding to a position of an LED element within the array of LED elements. Fastening means releasably attach each of the printed circuit board, the thermal conductor and the reflector array to a support surface within the interior cavity of the base. At least one optical element is releasably mounted on top of the reflector array by a set of mating bayonet fasteners. Each optical element has such fasteners on its upper and lower surfaces to allow stacks of optical elements to be releasably attached on top of the reflector array. An optional adapter ring may be releasably attached on top of the at least one optical element using the same bayonet fasteners, with a window snapped into the upper portion of the adapter ring. In an alternative embodiment, a right angle reflector may be attached to the top of the light module for use in a light fixture requiring radial light emission.

In another aspect of the invention, a light module for a lighting fixture having a base including an interior cavity includes a printed circuit board dimensioned to be received within the interior cavity of the base, the printed circuit board having a top surface and a bottom surface. An electrical connector extends from the bottom surface of the printed circuit board for attachment to an electrical socket within the base. A plurality of LED elements and one or more LED driver are mounted on the top surface of the printed circuit board, where the LED elements and LED driver are in electrical communication with the electrical connector. A thermal conductor is attached to the bottom surface of the printed circuit board, wherein the thermal conductor comprises contact surfaces that contact at least one inner surface of the interior cavity of the base. A light-directing element is disposed above each LED element, wherein the light-directing elements are arranged in an array. Fastening means are provided for releasably attaching the printed circuit board and the thermal conductor within the interior cavity of the base. At least one optical element is releasably disposed on top of the array of light-directing elements. In one embodiment, the light-directing element is a lens, such as a vertical-emitting lens or a side-emitting lens. In another embodiment, the light-directing element is a parabolic reflector. In a preferred embodiment, a plurality of individual parabolic reflectors is integrally formed into a reflector array configured to match the layout of at least a portion of the LED elements.

In still another aspect of the invention, a light module is provided for use in a lighting fixture having a lamp support base for retaining an electrical socket. The light module includes a printed circuit board releasably attached to the lamp support base with an electrical connector extending from the bottom surface of the printed circuit board for connection to the electrical socket. One or more LED elements and at least one LED driver are mounted on the printed circuit board so that the LED elements and the at least one LED driver in electrical communication with the electrical connector. A thermal conductor is in thermal contact with each of the printed circuit board and the lamp support base. A light-directing element is disposed above the one or more LED elements.

Thermal management for optimizing the life and efficiency of the light module is provided by a combination of heat sinks at the interior of the fixture and radiators on the exterior of the fixture. In preferred embodiments, the base of the fixture housing includes ribs or fins that dissipate heat that is conducted away from the light module.

BRIEF DESCRIPTION OF THE DRAWINGS

The present invention will be more clearly understood from the following detailed description of the preferred embodiments of the invention and from the attached drawings, in which:

FIG. 10A is a perspective view of the PCB, LEDs and drivers; FIG. 10B is a perspective view of the lamp assembly with filters and parabolic reflectors; FIG. 10C is a top view of the lamp assembly with filters; and FIG. 10D is an exploded side view of the lamp assembly with filters and parabolic reflectors.

FIG. 11A is a top view; FIG. 11B is a side view; and FIG. 11C is a perspective view.

DETAILED DESCRIPTION OF THE PREFERRED EMBODIMENTS

Figure 1:
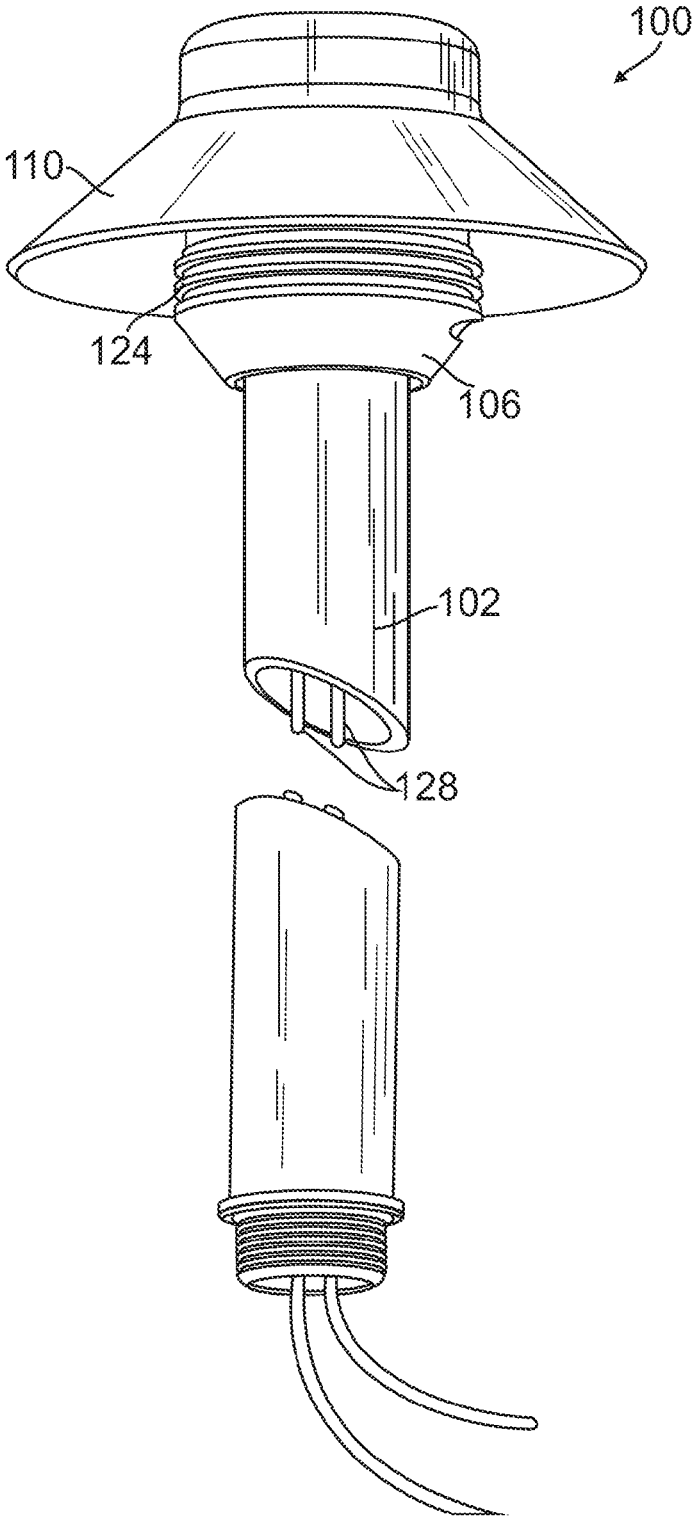
FIG. 1 is a perspective view of a pathway light fixture according to the present invention.

FIG. 1 illustrates a pathway lighting fixture generally designated by reference numeral 100. The lighting fixture 100 includes a stem in the form of a generally elongated tubular post 102 with a first end and a second end, the first end to which is attached to the lower end of the socket housing 104, and a lens assembly 108, which encloses the electrical components in a moisture-proof enclosure, disposed in the upper end of lens support 106, and a symmetrically flared reflector 110. Post 102 and reflector 110 should be made of a durable and aesthetically pleasing material. In the preferred embodiment, post 102 and reflector 110 are formed from solid copper, which is intended to oxidize to a verde finish and, thus, is preferably uncoated. Other corrosion resistant materials may be used as well, including stainless steel, anodized aluminum, powder-coated or painted metal, or high temperature plastics or composites.

Figure 2A:
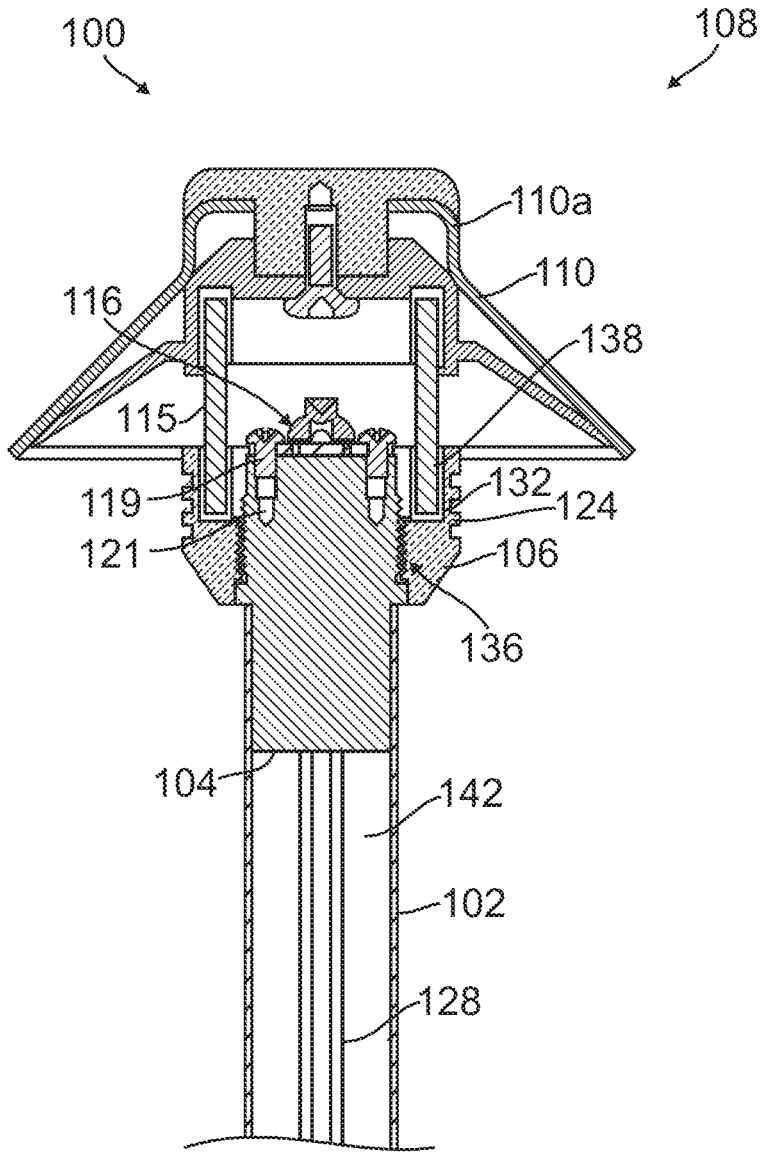
FIGS. 2A-B are side and perspective cross-sectional views, respectively, of the fixture head.
Figure 2C:
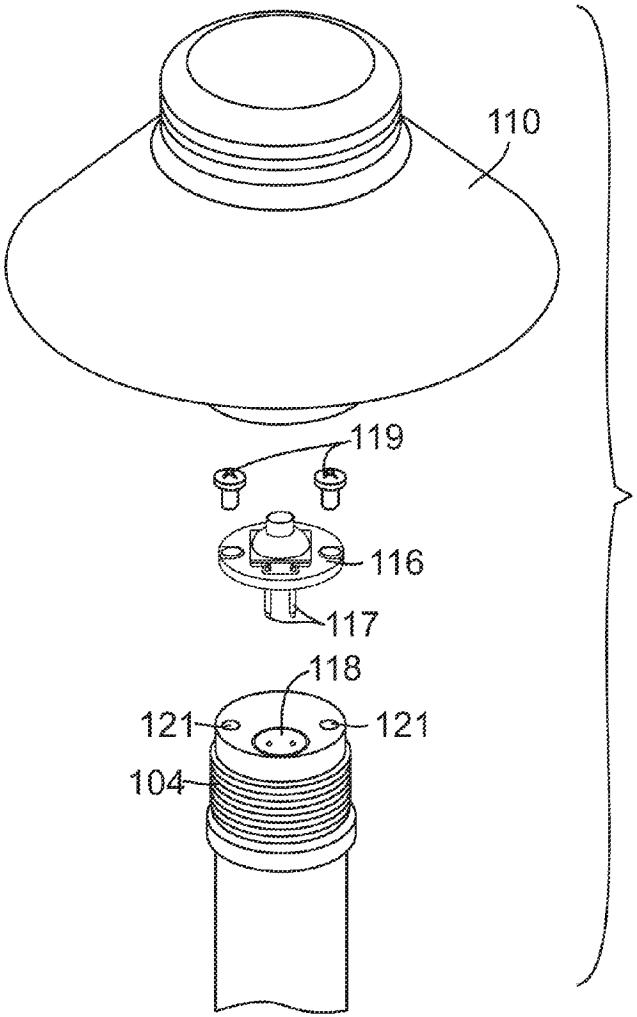
FIG. 2C is an exploded perspective view of the fixture head.
Figure 2B:
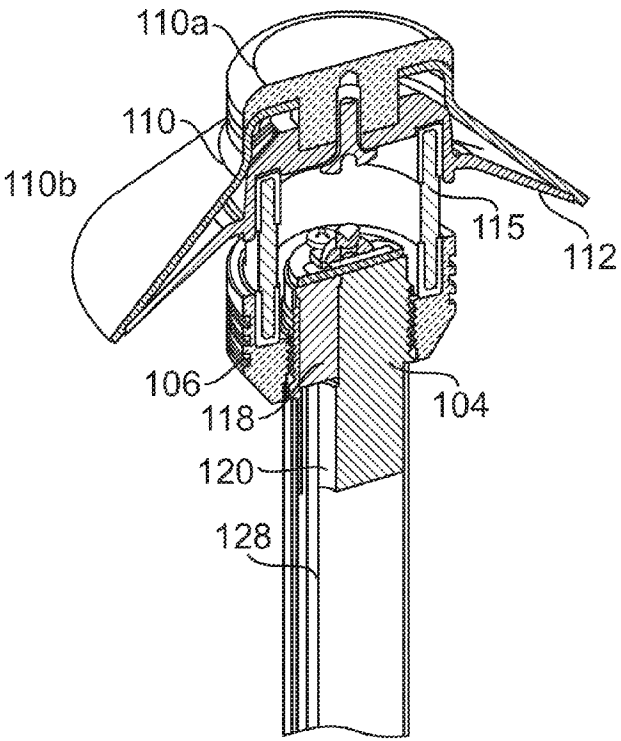
Figure 3A:
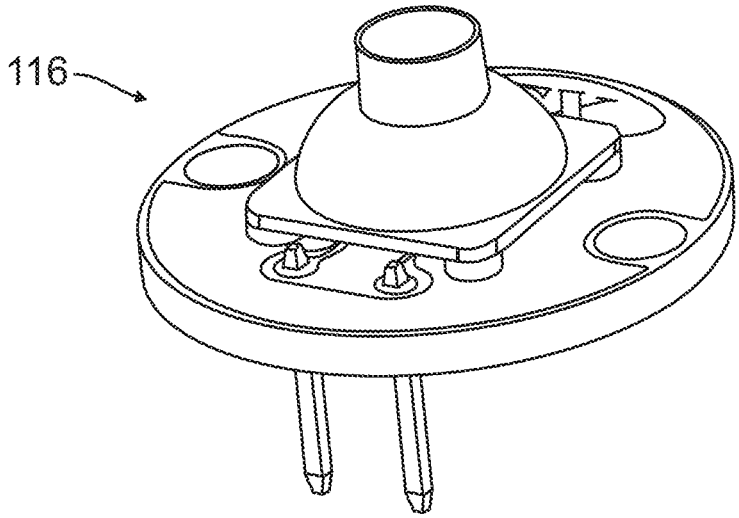
FIG. 3A is a side elevation of a lamp assembly according to an embodiment of the present invention.
Figure 3B:
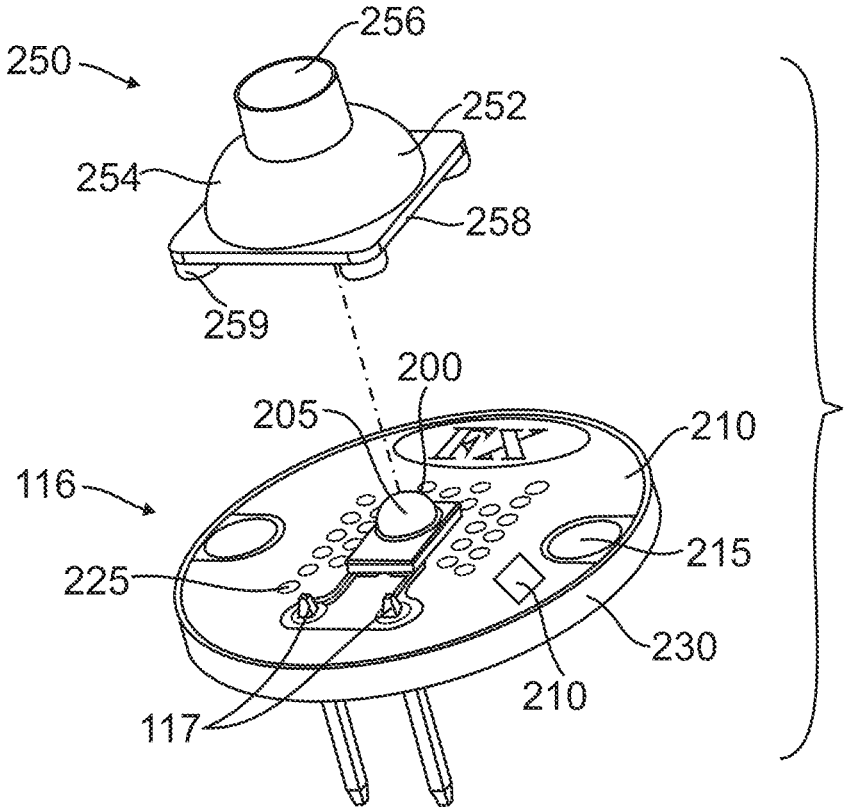
FIG. 3B is an exploded view of the lamp assembly of FIG. 3A.

The elements of lighting fixture 100 are shown in FIGS. 2A-C. Tubular post 102 has a first (upper) end, a second (lower) end, and a substantially hollow interior 142 through which electrical wires 128 pass to provide connection to a cable connected to a voltage source (not shown). In some embodiments, the voltage source is a low voltage (12 V) transformer which is connected to 120 VAC.

In the socket assembly, socket housing 104 is generally cylindrical in shape and fits within the upper end of post 102. Socket housing 104, which molded or machined from a thermally conductive material, such as metal, retains socket 118 which receives electrical posts 117 that extend from the bottom of lamp assembly 116 to provide electrical connection to the lamp assembly 116. Socket 118 is preferably a two-hole socket of the type commonly used for halogen bulbs such as 2 pin JC- or MR-type bulbs, since an object of the present invention is to provide simple means for replacement of conventional halogen bulbs with the LED lamp assembly 116. Lamp assembly 116 is held firmly in place on top of socket housing 104 by screws 119 which are received in threaded bores 121. Screws 119 may also provide additional thermal conduction from the lamp assembly to socket housing 104. Wires 128 extend through socket housing 104 where they are connected at their upper ends to socket 118. The other ends of wires 128 are fed down through interior 142 of post 102 for connection to an input voltage source such as a battery connected to a solar PV panel or a low voltage transformer.

Lens support 106 has an exterior shape that is generally cylindrical or a frustum, as shown, with a hollow interior. The central bore of lens support 106 is threaded to mate with external threads on socket housing 104. In the preferred embodiment, lens support 106 is formed from brass or other conducting material to further disperse heat from the socket housing 104. Annular channels 124 may be formed in the outer surface to provide the dual functions of: 1) facilitating grasping the lens assembly during disassembly and reassembly of the fixture and 2) acting as heat radiating fins to provide further heat dissipation for lamp assembly 116, as will be discussed in more detail below.

Referring now to FIGS. 3A, 3B and 5A, 5B, lamp assembly 116 is provided in both assembled and exploded views, respectively. Lamp assembly 116 includes an LED component 200 having an LED bulb 205 and a driver circuitry module 220 coupled to a PCB 210. In some embodiments, LED component 200 is coupled to driver circuitry module 220. The driver circuitry module 220 is preferably used to covert the incoming voltage from the voltage source (not shown) to an appropriate voltage for the LED component 200, e.g., stepping up or stepping down the voltage as desired.

PCB 210 includes a heat sink 230 integrated therein. For example, in one embodiment, PCB 210 includes metal paste that is used to fill through-holes 225 in the PCB to form metal plugs that conduct heat from the LED component, thereby acting as a heat sink such that the heat is transferred from the front of PCB 210 immediately below the LED component 200 to the back of the heat sink PCB 210 and to the top of socket housing 104. PCB 210 includes mounting holes 215 through which screws 119 may be inserted to provide physical connection and, possibly, additional thermal conduction, to socket housing 104.

Also integral to PCB 210 are a plurality of electrical posts 117 which extend through and are connected to PCB 210 via electrical conductors (not shown). As described above, electrical posts 117 are plugged into socket 118 in communication with electrical wires 128, which provide connection to a cable connected voltage source (not shown). Thus, electrical posts 117 provide power to the components within lamp assembly 116. In one embodiment, the electrical posts 117 are dimensioned and spaced to fit into a socket that is intended for use with conventional halogen bulbs, e.g., MR16 and the like.

Lamp assembly 116 further includes a lens assembly 250 for directing light away from the LED, i.e., a light-directing element. Lens assembly 250 may include a side emitter lens 252 such as shown in FIG. 3, or may include a vertical emitter lens 262 such as shown in FIG. 5. Both side emitter lens 252 and vertical emitter lens 262 preferably include a base portion 254, 264 and a top portion 256, 266, respectively. As used herein, the base portion refers to the portion of the lens that is in contact with a housing component, as will be now discussed.

Figure 4:
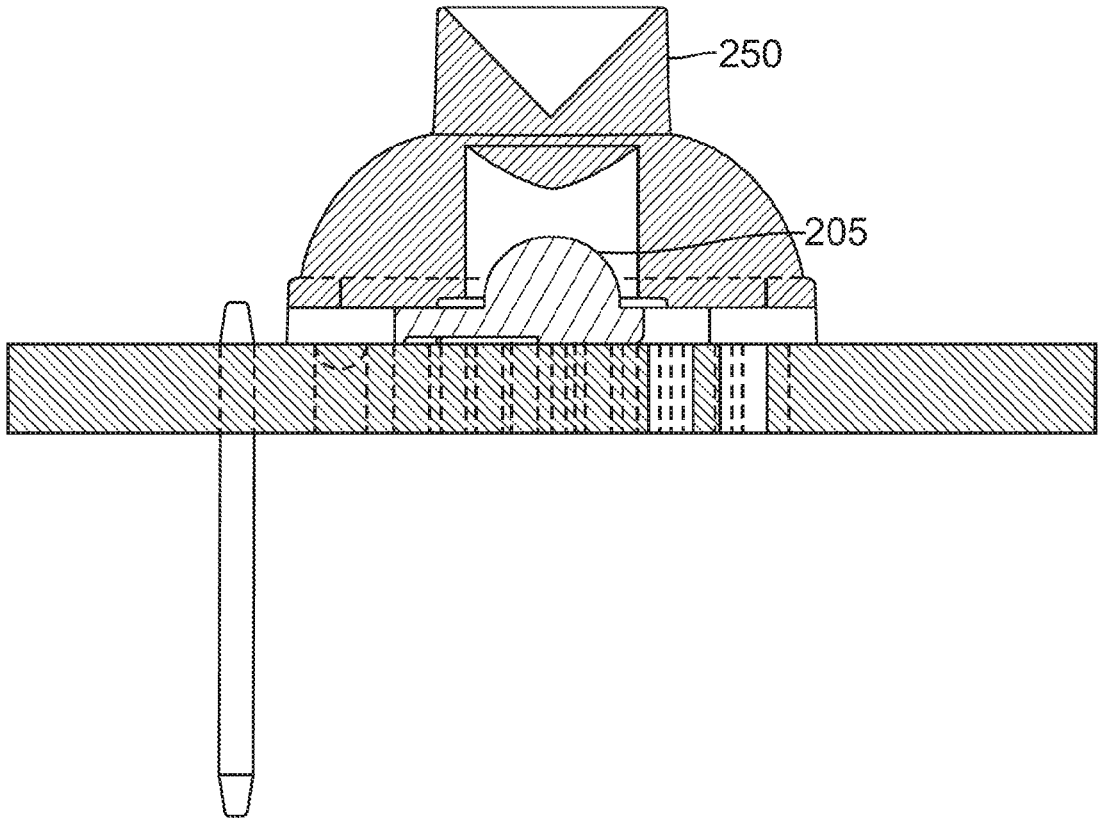
FIG. 4 is a perspective view of the lamp assembly of FIG. 3A.
Figure 5A:
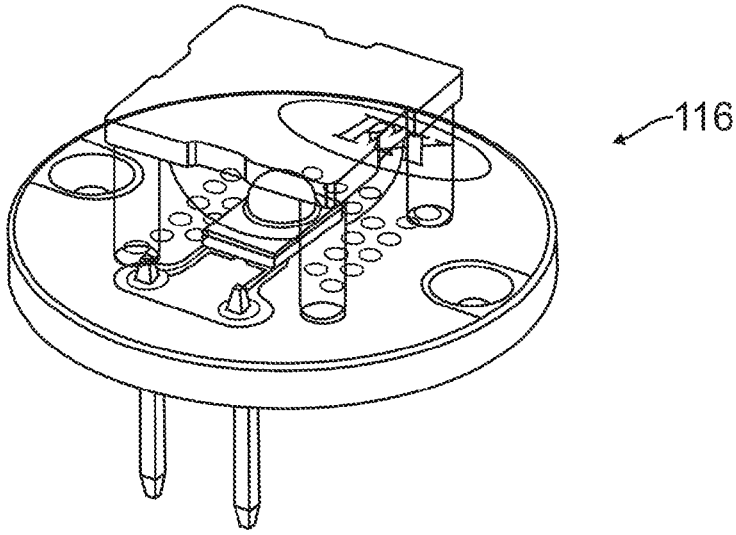
FIG. 5A is a side elevation of a lamp assembly according to an embodiment of the present invention.
Figure 5B:
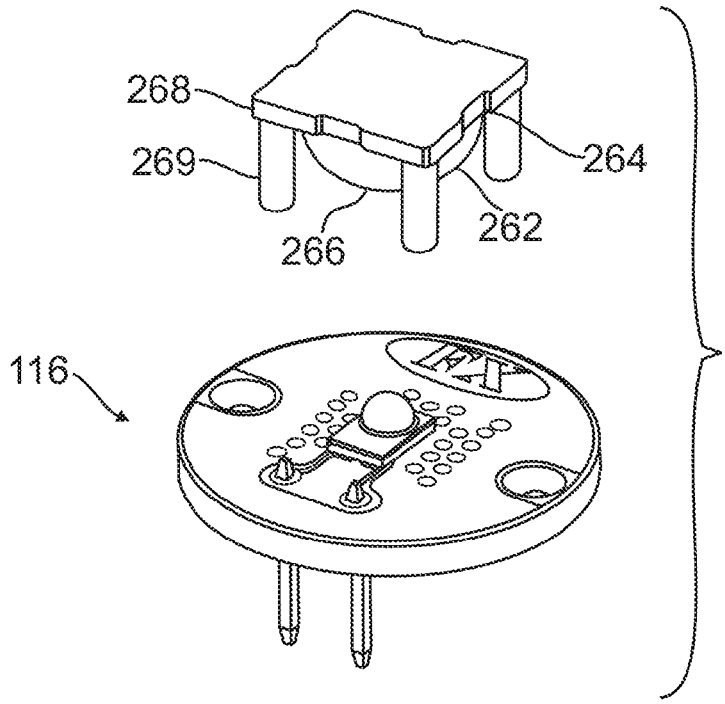
FIG. 5B is an exploded view of the lamp assembly of FIG. 5A.

Referring to both FIGS. 3 and 4, in an exemplary embodiment, lens assembly 250 having a side emitter lens 252 includes a housing component 258, formed at the base portion 254 of side emitter lens 252. Housing component 258 includes one or more feet 259 which provide attachment to PCB 210. As is appreciated, base portion 254 of side emitter lens 252 allows light from LED bulb 205 to diffuse through the lens so that the surroundings may be provided with light.

Referring now to FIG. 5, in an exemplary embodiment, lens assembly having a vertical emitter lens 262 includes a housing component 268, formed at the base portion 264 of vertical emitter lens 262. Housing component 268 includes one or more feet 269 which provide attachment to PCB 210. As is apparent from FIG. 5, feet 269 surround vertical emitter lens 262, partially enclosing vertical emitter lens 262.

Figure 6:
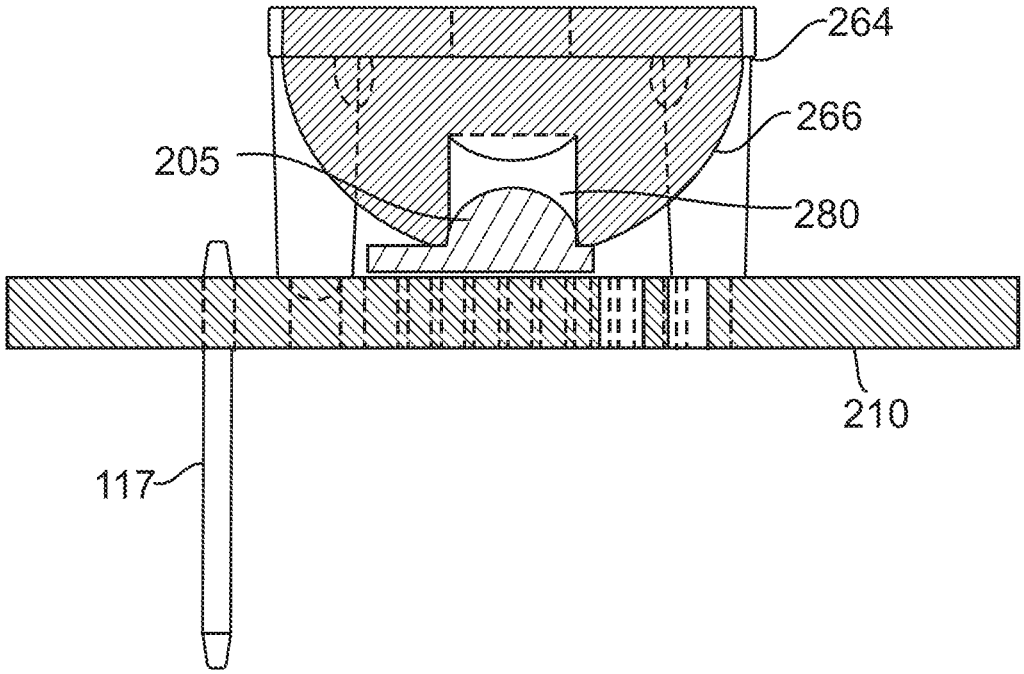
FIG. 6 is a perspective view of the lamp assembly of FIG. 5A.

As shown in FIG. 6, the top portion 266 of vertical emitter lens 262 includes a concave portion or a recess 280 allowing for LED bulb 205 to be received within the vertical emitter lens 262. Similar to side emitter lens 252, base portion 264 of vertical emitter lens 262 allows light from LED bulb 205 to diffuse through the lens so that the surroundings may be provided with light.

Referring back to FIG. 2, in the preferred embodiment, socket housing 104, also referred to as the base, is formed from brass or other conductive material. An epoxy 136, silicone or other adhesive is used to attach the base 104 to post 102, and provides insulation between the outer surface of socket housing 104 and the inner surface of post 102 to minimize direct metal-to-metal contact and the resulting possible enhancement of corrosion by galvanic action between the brass and copper.

As described above, lens support 106 is also formed from brass or other conducting material and may include annular channels 124 formed in the outer surface of lens support 106.

The proximity of PCB 210 to socket housing 104 (e.g., PCB 210 abutting socket housing 104) and the proximity of socket housing 104 to lens support 106 (e.g., socket housing 104 abutting lens support 106) provides a channel for heat dissipation for PCB 210. By virtue of their inherent shape, annular channels 124 behave as heat fins, aiding in dissipating heat generated by lamp assembly 116. The depth of the annular channels may be adjusted depending on the anticipated degree of thermal dissipation. For example, a fixture intended for relatively high lumen output will have a greater number of LEDs and, thus, may need deeper channels for increased heat dissipation. Thus, the thermal management of the lamp assembly 116 is much more efficient than previous known systems.

In some embodiments, sockets 118 are formed from a non-conductive body of plastic or other durable, non-conductive materials. A pair of metal posts or conductors 117 passes through the body where they are configured to receive the electrical wiring of lamp assembly 116 at a first end. At the second end, conductive wires 128 enter the sockets 118 where they are attached to the metal posts 117 to provide for connection to a low voltage cable and voltage source, such as a transformer. Socket 118 is inserted through a bore 120 formed in socket housing 104 where it is firmly held by an interference fit. The outer surface of the socket may be configured with a series of small vertically aligned ribs (not shown) to enhance the grip between the outer surface of socket 118 and the inner surface of the socket bore 120.

In the lens assembly 108, reflector 110 is generally bell shaped with a crown portion 110*a* which is generally cylindrical and a skirt portion 110*b* which flares out from the crown portion 110*a* to form a frustum. Reflector 110 may be formed by machining, die casting, molding, or any other procedure appropriate for the selected materials. In the preferred embodiment, reflector 110 is formed from copper or brass, but may also be formed from aluminum or stainless steel, which may be powder coated. Other shapes may be substituted as long as a sufficient recess is provided to enclose the lamp and socket sufficiently to prevent direct viewing of the lamp from above the fixture. For example, tulip or other bell-like flower shapes, pyramids, half-shells, such as a scallop shell, or cones may be used. The shapes are not limited to rounded or symmetrical shapes. Optionally, a reflector liner 112 formed from a plastic or polymer, preferably white or light colored, may be attached to the underside of reflector 110 to enhance reflectivity. As illustrated, liner 112 is attached via a screw to the interior of crown portion 110*a*. Liner 112 is molded to fit closely around the outer edges of lens 115 where it may be held in place by either an epoxy adhesive (for permanent attachment) or by a silicone channel ring (for releasable attachment) such as that described in U.S. application Ser. No. 12/581,688, filed Oct. 19, 2009, which is incorporated herein by reference.

A cylindrical lens 115, which surrounds lamp assembly 116, has an outer diameter and thickness adapted to fit within channel 132, which is formed in the upper edge of lens support 106, and an outer diameter to fit closely within crown portion 110*a* of reflector 110. Lens 115 can be transparent or translucent glass, plastic or similar material, preferably impact resistant and capable of withstanding outside environmental conditions without degradation. In the preferred embodiment, lens 115 is a frosted, tempered glass to serve as a diffuser, providing uniform dispersion of light and optimal tolerance of moisture, temperature and sunlight exposure. A diffuser can also be provided by forming a knurled, ribbed or other roughened texture on either the inner or outer surface of lens 115. An adhesive 138, such as epoxy, silicone or other adhesive is placed in channel 132 to provide a seal against moisture intrusion and to act as a shock-absorber for the lens. Reflector 110 is mounted concentrically atop lens 115, with the upper portion of lens 115 inserted into the crown portion 110*a* of reflector 110 and fixed in place with the application of an epoxy, or silicone-based or similar adhesive that can create a watertight seal.

Figure 7:
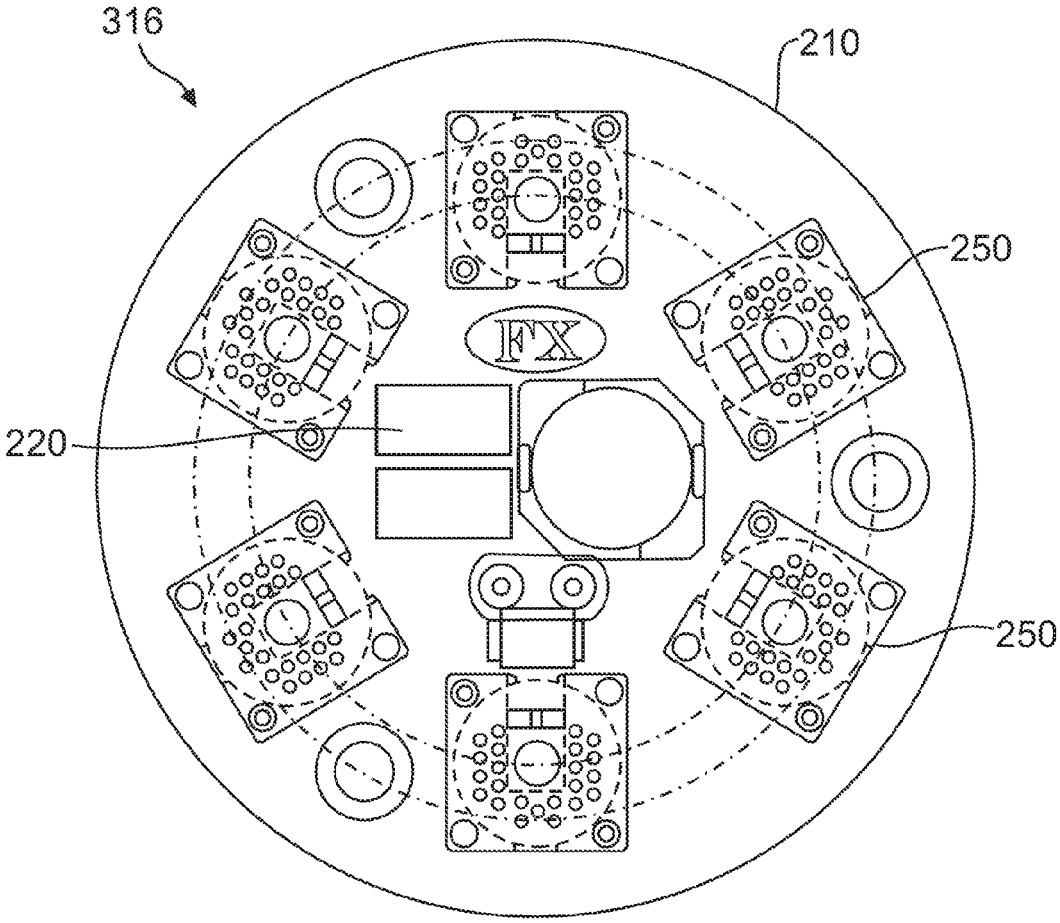
FIG. 7 is a top elevation of a lamp assembly according to an embodiment of the present invention.

Referring now to FIG. 7, a lamp assembly 316 is shown including a plurality of LED & lens assemblies 250 and driver circuitry modules 220 on PCB 210. In each location on the PCB 210 immediately below an LED/lens assembly, through-holes are formed with a conductive material to conduct heat away from each LED to the bottom of the PCB, which will be in contact with a heat sink such as socket housing 104. In some embodiments, the operation of lamp assembly 316 is similar to lamp assembly 116.

Benefits associated with the lamp assemblies described herein include the ability to utilize LED lighting components in existing lighting fixtures currently configured for two-pin halogen lamps. Furthermore, by placing an LED lighting component and its associated driver circuitry on a single PCB, the lamp assembly may be used to retrofit currently existing pathway light fixtures. Lastly, utilizing lens support 106, and in particular annular channels 124, for heat dissipation allows the present lamp assemblies to operate efficiently and without premature burnout.

Figure 8A:
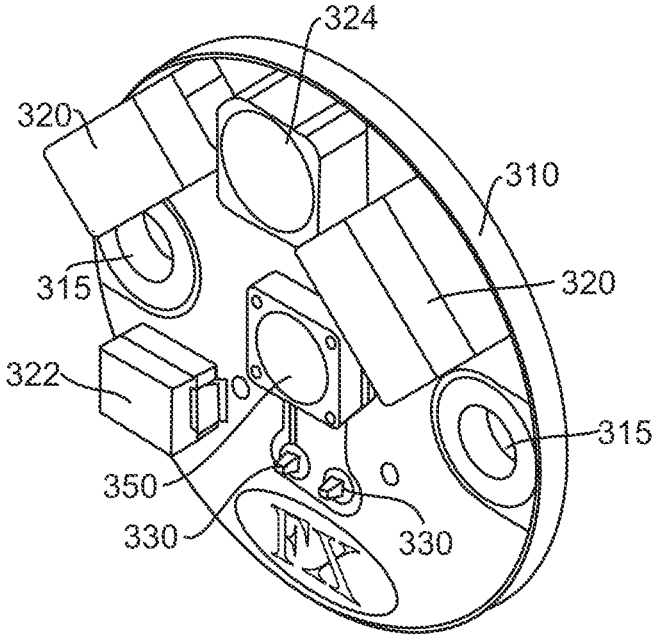
FIGS. 8A and 8B are perspective views of the top and bottom, respectively, of an alternative embodiment of the lamp assembly according to the present invention.
Figure 8B:
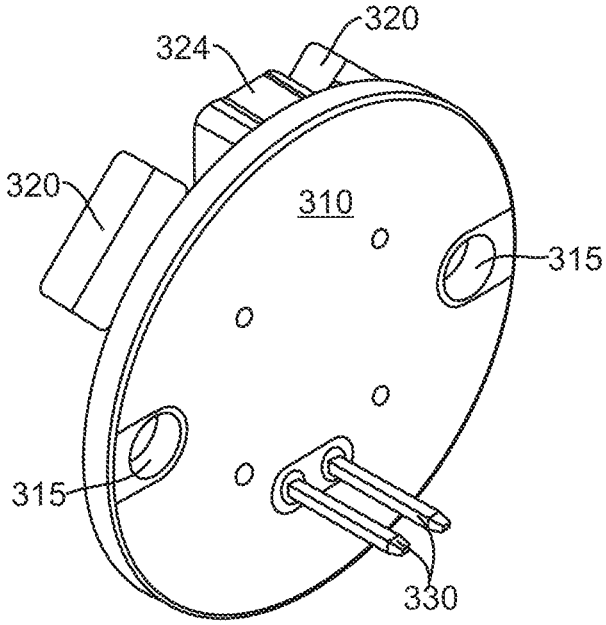

FIGS. 8A and 8B illustrate an alternative embodiment of the LED assembly for use in lighting fixtures. Mounted on PCB 310, which has a diameter on the order of 2.5 cm (~1 in.), is a single LED and lens 350 at the center of the PCB 310. The lens has a similar configuration to that described with reference to FIG. 6. Driver components 320, 322 and 324 are distributed around the board. Two pin connectors 330 extend from the underside of PCB 310 to plug into a standard two pin socket as is normally used with halogen lamps. On the front side of the board, pin connectors are in electrical communication with the driver components 320, 322 and 324 which are in electrical communication with the LED (not shown) located beneath the lens 350. Through holes 315 are dimensioned to accept a screw (not shown) for securing the LED lamp assembly to the socket housing, such as socket housing 104 shown in FIG. 2*a*. Smaller through holes are formed through the board at positions equidistant from the board's center, where the LED is located.

Figure 9A:
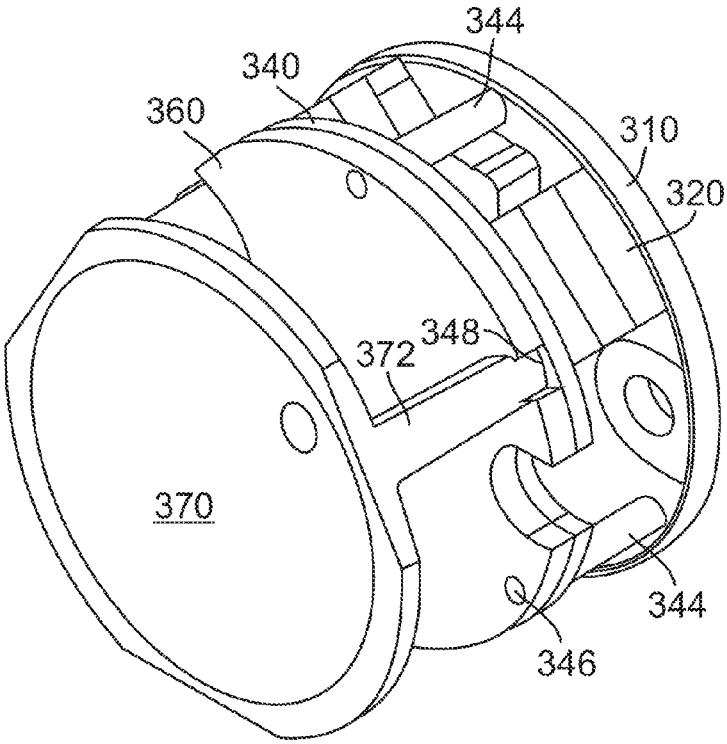
FIGS. 9A and 9B are perspective and exploded side views, respectively, of a lamp assembly with reflectors for optimizing light output and an optional filter.
Figure 9B:
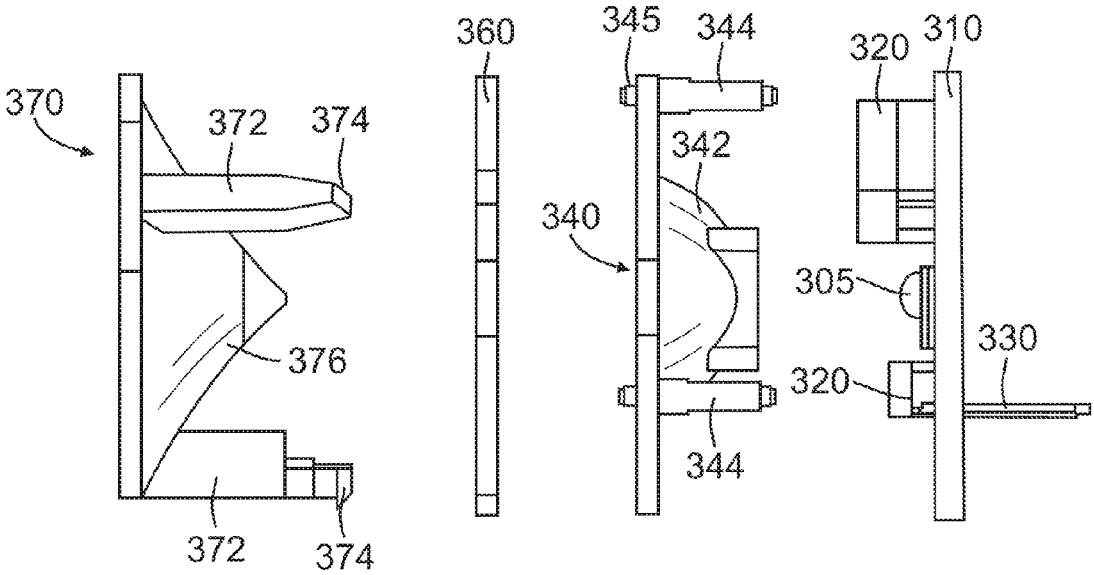
Figure 10A:
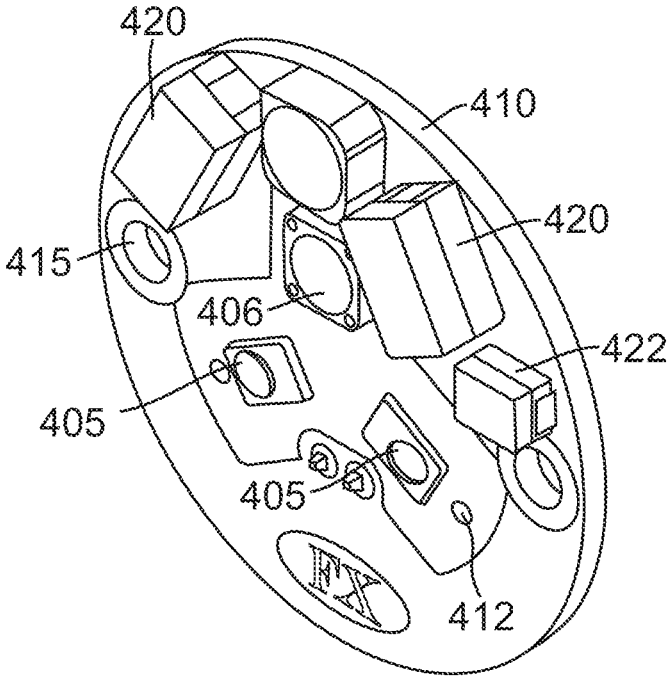
FIGS. 10A-D show a 3 LED lamp assembly, where
Figure 10B:
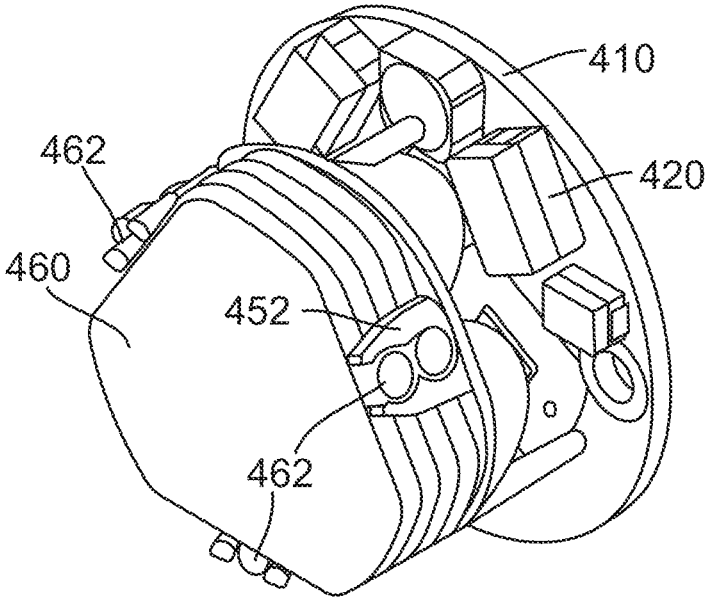
Figure 10C:
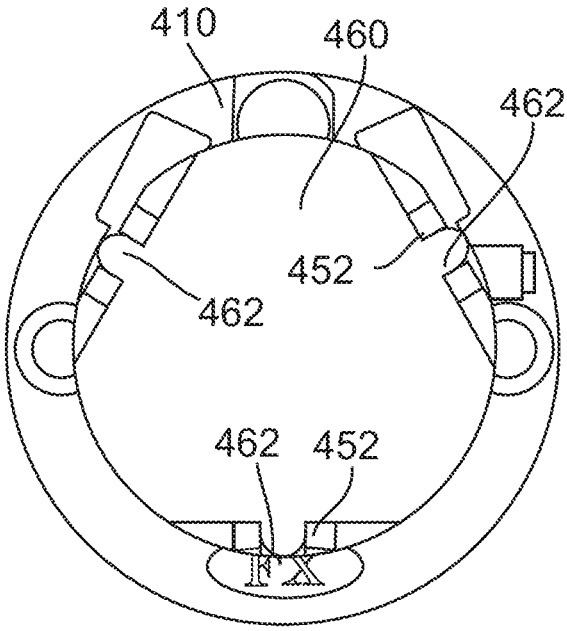
Figure 10D:
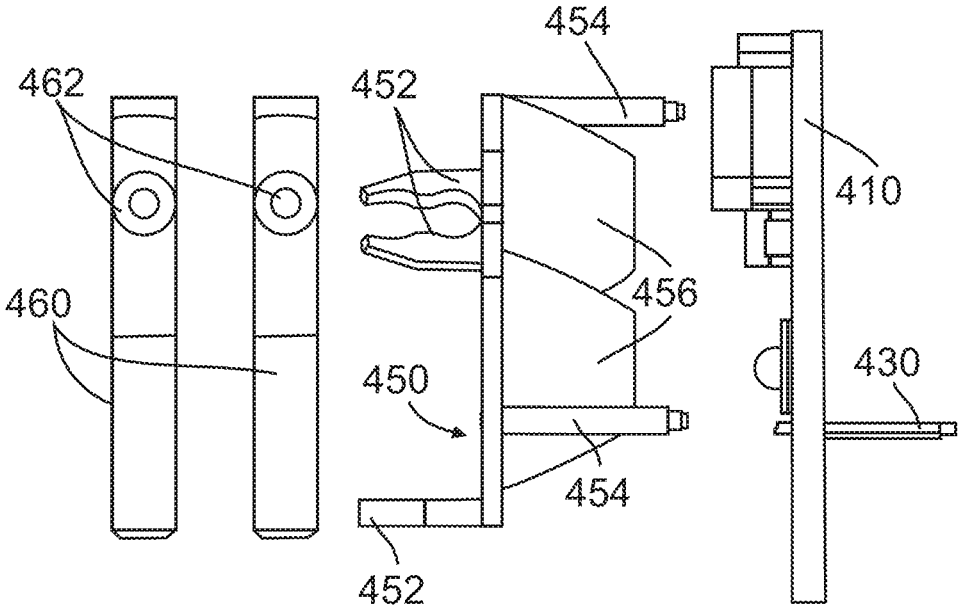

FIGS. 9A and 9B illustrate an enhancement to the LED lamp assembly of FIG. 8. The layout of the board 310, LED 305 and driver components 320, 322 and 324 are the same as those shown in FIG. 8. However, a combination of reflectors and an optional filter provide several advantages over the embodiment of FIG. 8. Attached on top of the board 310 is a parabolic reflector assembly 340 which has a flattened area and an opening at its center to fit over the LED so that the LED is aligned with the opening, so that the light emitted by the LED is directed through the opening. At least the inner surface of the parabolic reflector 342 of reflector assembly 340 is mirror coated to provide a highly reflective surface to maximize light transmission outward from the LED. Each parabolic reflector in the assembly is a light-directing element. Reflector assembly 340 is preferably formed from polycarbonate or other appropriate plastic which is coated with an aluminum reflective surface either on over the entire component or only on the upper surface. Mounting pins 344 extend downward from reflector assembly 340 and are inserted into corresponding through-holes (not shown) formed in board 310. Pins 344 are preferably secured in place with an adhesive, but may also be press fit into closely dimensioned holes for a firm fit. Alternatively, pins 344 may be hollow with a bore threaded to accept a mounting screw so that the reflector assembly 340 can be removeably attached. Extending upward from the upper surface of the reflector assembly 340 are extensions 345 of pins 344. The extensions 345 are dimensioned to fit within openings 346 of an optional colored filter 360 which will allow customization of the color of light emitted by the LED lamp assembly. As is known in the art, LEDs are "binned" based on flux, color (dominant wavelength) and forward voltage. The more specific the performance requirements of an LED, the narrower the binning, and the more expensive the LED. The ability to select custom optical elements (filters or diffusers) to be used with LEDs allows more flexibility with the color control, allowing the use of less costly, e.g., standard, LEDs while still retaining the ability to specify desired wavelengths in a fixture. The filter 360 is preferably releasably retained on the extensions 345 so that it may be changed or removed if desired.

A right angle reflector assembly 370 is affixed on the top of reflector assembly 340 and, if used, filter 360 to direct light radially from the LED. As with reflector assembly 340, right angle reflector assembly 370 is preferably formed from plastic, such as polycarbonate and coated with a reflective material, such as aluminum, to create a mirrored surface at least on the conical lower surface 376 of the reflector assembly 370. Extending downward from the upper edges of the reflector assembly 370 are legs 372 and alignment feet 374 which are configured to releasably snap lock into notches 348 formed in the outer ring of parabolic reflector assembly 340. Alternatively, the right angle reflector assembly may be attached to the reflector assembly by other attachment methods, including screws, or a bayonet type coupling (not shown). The high reflectivity of the right angle reflector ensures that the light is transmitted radially out of the LED lamp assembly with maximum efficiency.

FIGS. 10A-10D illustrate an alternative embodiment which combines a multiple LED arrangement with parabolic reflectors and filters. On PCB 410, three LEDs 405 and 406 are positioned among the driver components 420, 422 and 424. As illustrated, two different types of LEDs are used to provide a mix of colors or other characteristics. All three may be the same type of LED, or three different types may be used, depending on the desired effects. Through-holes 415 in board 410 provide means for firmly attaching the LED assembly to a socket housing. Pins 430 extend from the bottom of PCB 410 for insertion into a socket. Through-holes 412 provide means for attaching parabolic reflector assembly 450 to the board 410. Parabolic reflector assembly 450 includes an annular frame portion from which extend support legs 454, the feet of which snap into holes 412. A separate parabolic reflector 456 is provided for each LED 405, 406 so that the reflector 456 fits closely around the LED for efficient light transfer away from the LED. Extending upward from the frame of reflector assembly 450 is a set of notched tabs or latch 452 (three are shown) which are configured to receive pegs 462 which extend from the edges of filters 460 to firmly but releasably retain the filter(s) 460 in position on top of the reflector assembly. A single color or frosted filter may be used or multiple filters may be combined to create a desired effect.

Figure 11A:
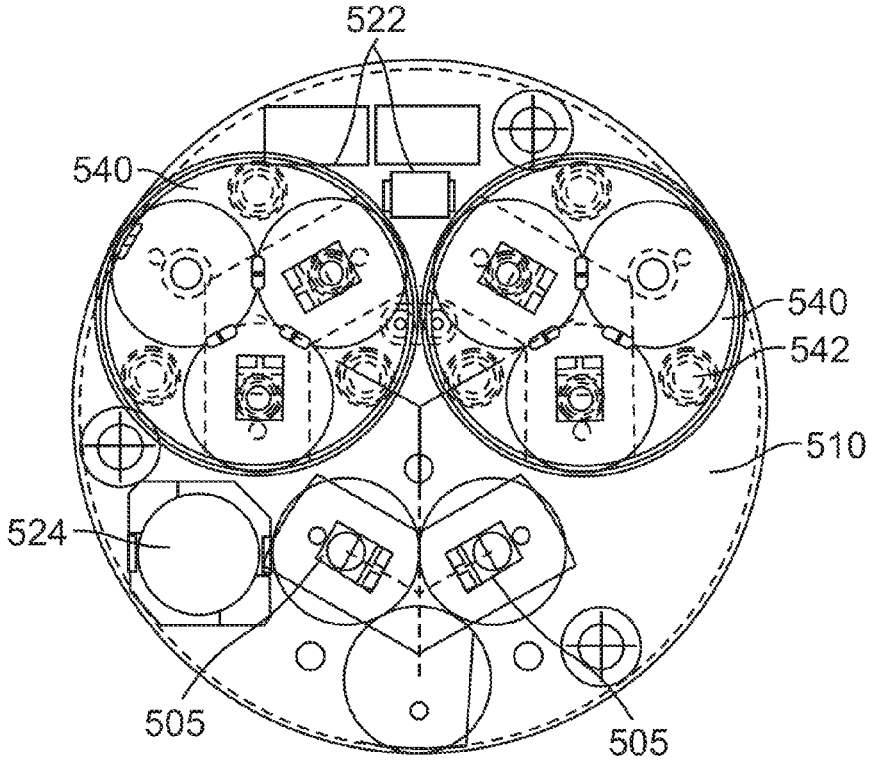
FIGS. 11A-C illustrate a 6 LED assembly with lenses and parabolic reflectors where
Figure 11B:
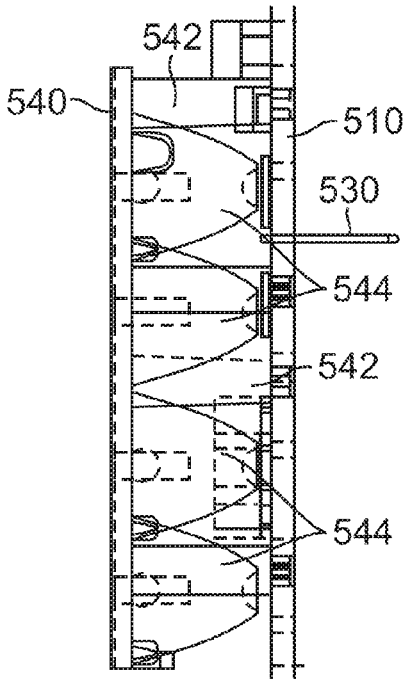
Figure 11C:
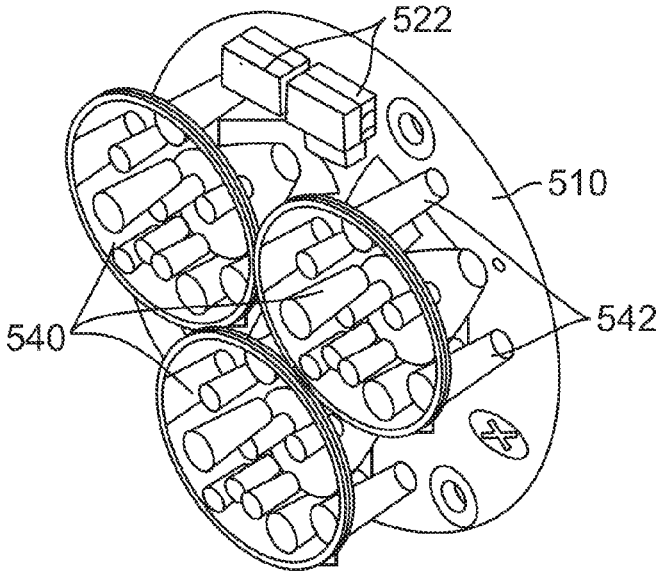
Figure 12:
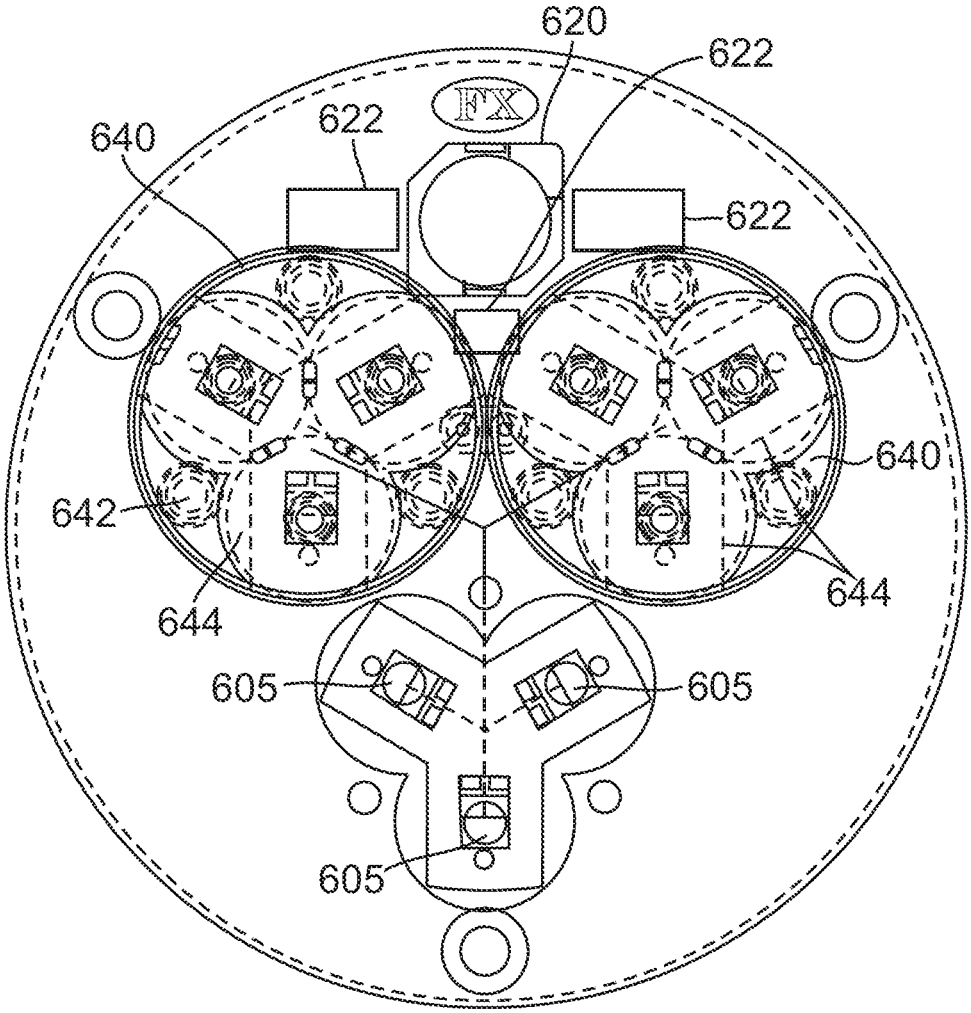
FIG. 12 is a top view of a 9 LED assembly with lenses and parabolic reflectors.

FIGS. 11A-11C illustrate a multi-LED arrangement with 9 LEDs. The LEDs are divided into three groups of three. A group of three LEDs 505 and parabolic reflector assembly 542 with a parabolic reflector 544 corresponding to each LED group are covered by a single filter 540 (or group of filters). Thus, the entire LED lamp assembly has three filters 540 within the outer dimension of the PCB 510. Different types of drivers 522, 524 are used to maximize capacity while fitting in the available area on the PCB 510. Prongs 530 extending from the bottom of the PCB 510 fit into a standard two-prong socket. FIG. 12 illustrates a variation of the 9 LED lamp assembly with slightly different positioning of the drivers 620, 622 on PCB 610. LEDs 605, parabolic reflector arrays 642 with parabolic reflectors 644 and filters 640

Figure 13A:
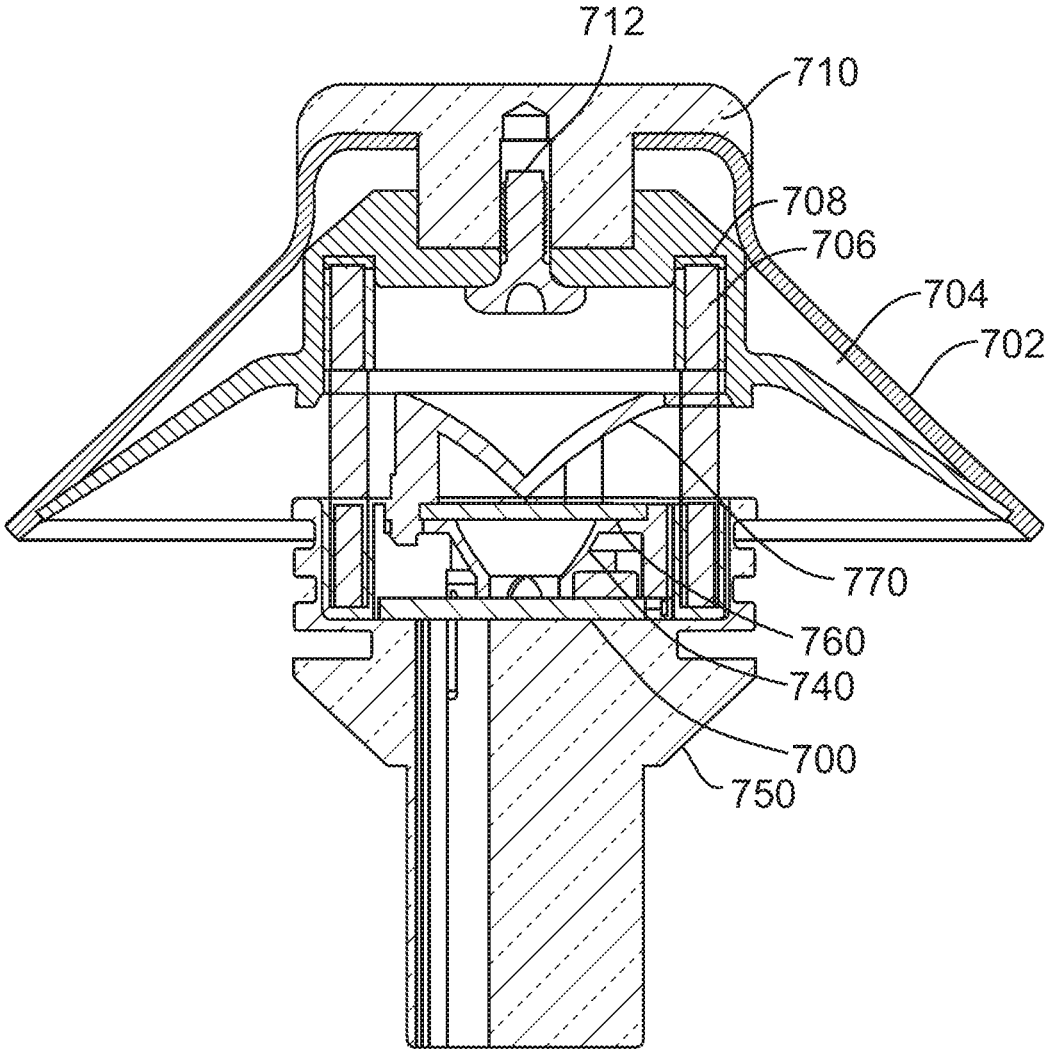
FIG. 13 is a cross-sectional view of a pathway light fixture incorporating the reflectors of FIGS. 9A and B.

FIG. 13 illustrates an alternative embodiment of the pathway light fixture with a single LED lamp assembly 700. As illustrated, the hood assembly includes a hood 702, a molded hood liner/reflector 704, a cylindrical lens/diffuser 706, a metal cap 710 and a mounting screw 712. A silicone seal or sleeve 708 can be used to form a substantially watertight seal between the diffuser 706 and the reflector 704 at the top and between the diffuser 706 and the housing 750 at the bottom. Similar hood assemblies are described in U.S. Pat. No. 7,387,409 of Beadle, and application Ser. No. 12/581,688, also of Beadle, both of which are incorporated herein by reference. A parabolic reflector 740 surrounds the LED to maximize the amount of light directed upward, while the right angle reflector 770 reflects the light outward from the fixture's axis, to maximize the light emitted from the fixture. An optional color filter 760 may be supported and attached on top of parabolic reflector 740. The LED assembly 700 is retained within metal housing 750 with good thermal contact between the back of LED assembly 700 and the support surface of the housing 750. Ribs 752 serve as a heat sink as well as contributing to the aesthetics of the fixture. Electrical connections to the LED assembly are made by way of the pin 754 which extends down into a bore formed in the housing.

Figure 14A:
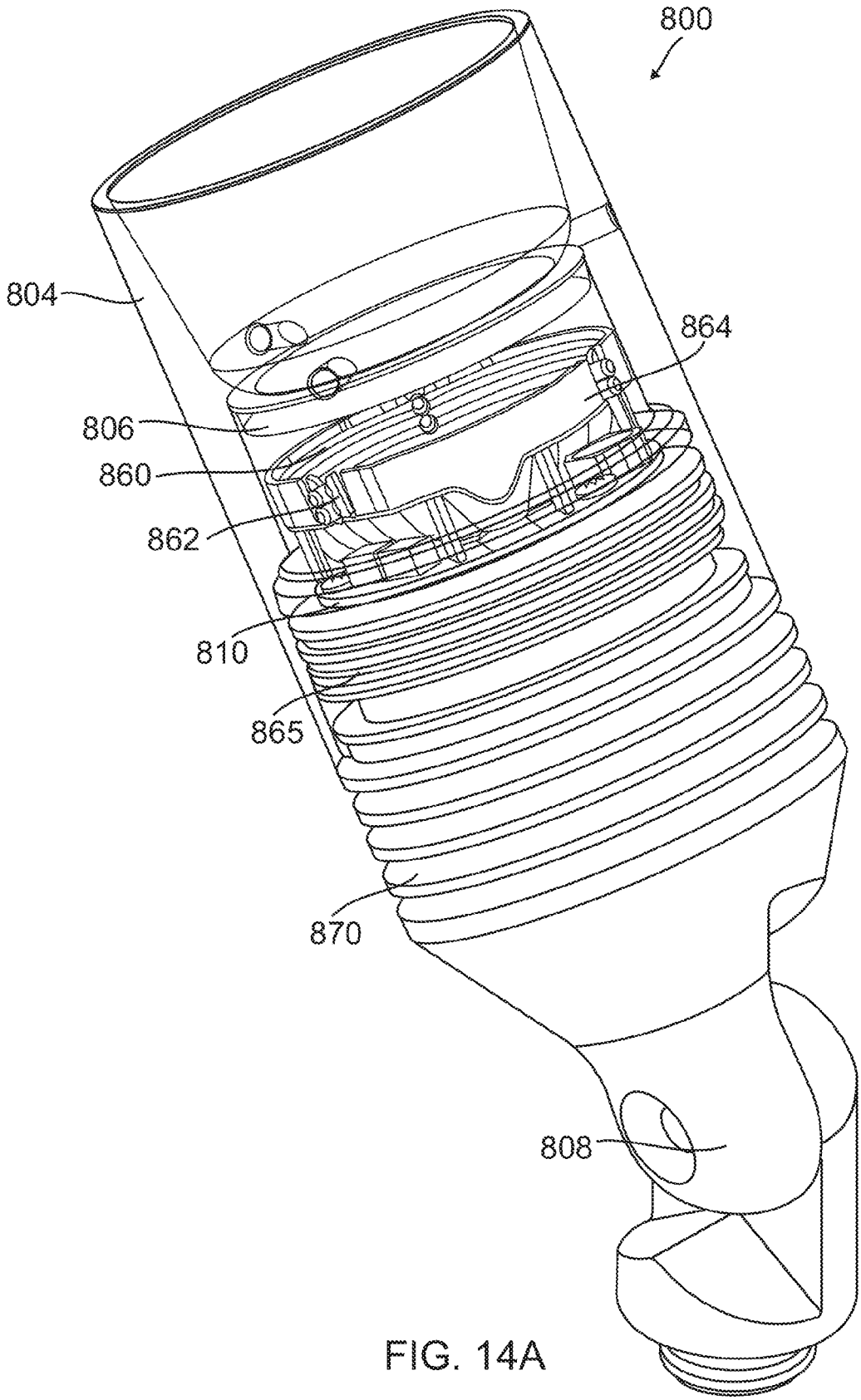
FIG. 14A is a perspective view of an uplight fixture incorporating the LED lamp assembly with parabolic reflectors and filters.
Figure 14B:
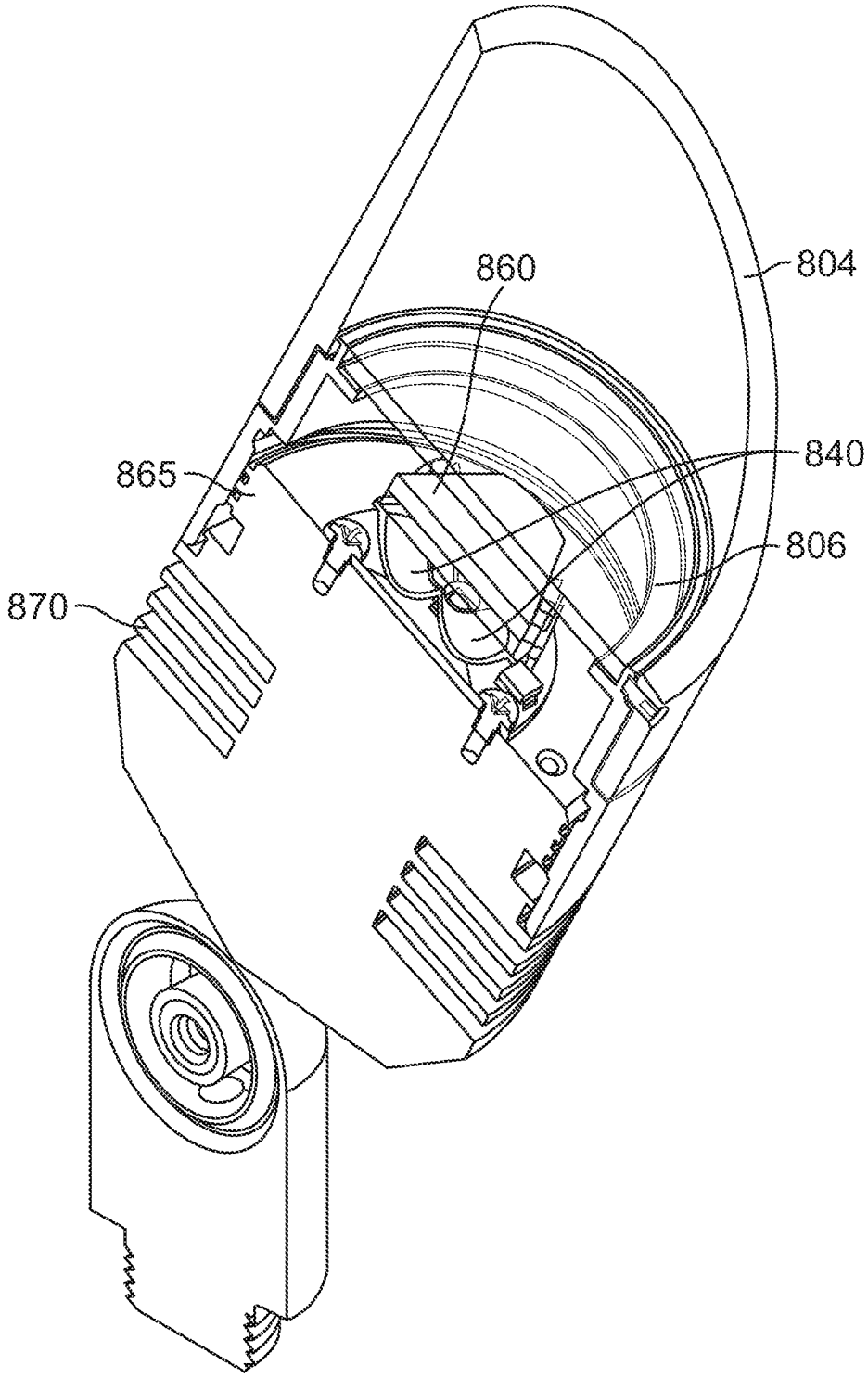
FIG. 14B is a cross-sectional perspective view of the fixture of FIG. 14A with multiple LEDs.
Figure 14C:
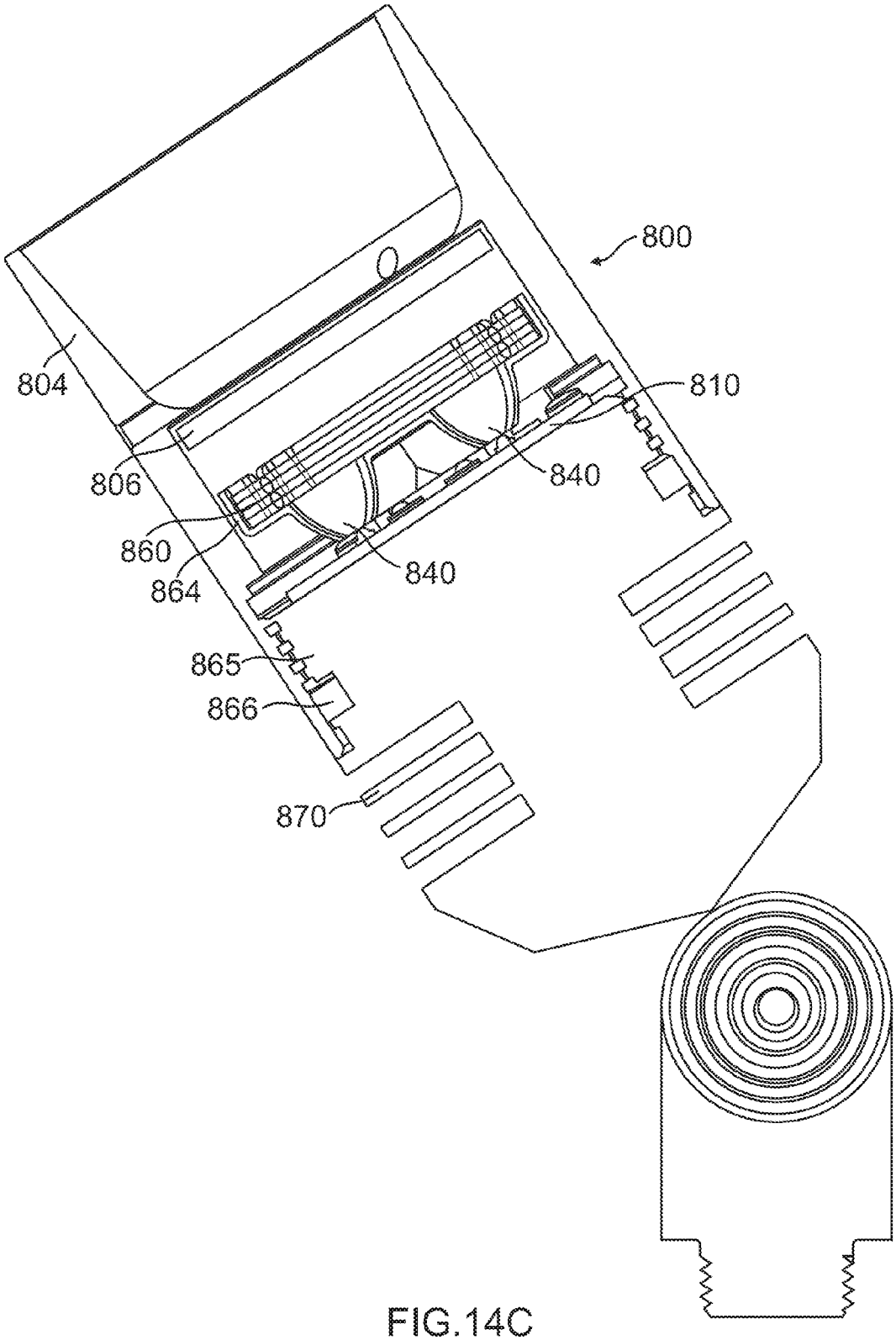
FIG. 14C is a cross-sectional side view of the fixture of FIG. 14A.

FIGS. 14A-14C provide different views of a spot light fixture 800 that incorporates a multi-LED lamp assembly on PCB 810 with parabolic reflectors 840 for reflecting the light upward through one or more filters 860 that are supported within frame 864 which is enclosed within housing 804. Base 865 is preferably brass or similar heat-conducting metal. Fins 870 formed integrally with based 865 draw heat away from the LED assembly for thermal management. Window 806 encloses the entire lighting assembly (lamp assembly, reflectors and filter(s)) to prevent contamination from entering the fixture. The fixture 800 is shown mounted on a knuckle joint 808 such as that disclosed in U.S. Pat. No. 6,902,200 of Beadle.

Figure 15A:
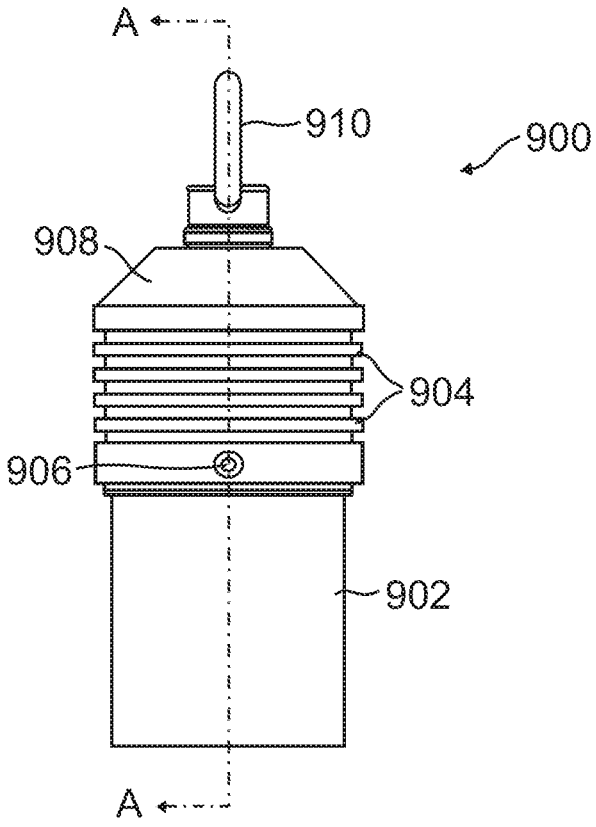
FIGS. 15A-15B are a front plan view and a cross-sectional view of a hanging light fixture incorporating the LED lamp assembly with parabolic reflectors and filters.
Figure 15B:
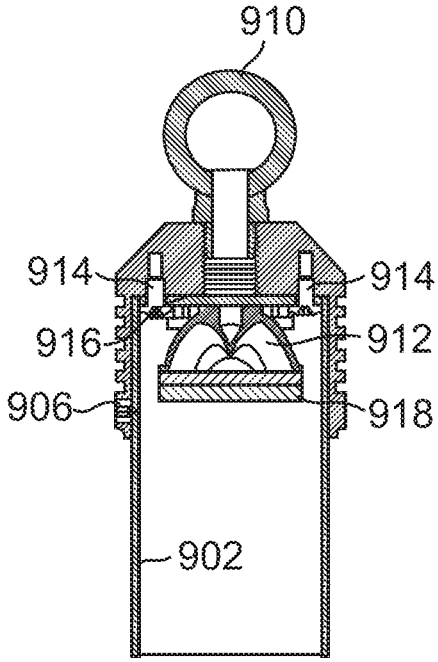

FIGS. 15A-15B illustrate a hanging light fixture 900 with the multi-LED lamp assembly on the PCB 916 along with corresponding electrical and optical components, including parabolic reflectors 912 and snap-on filters 918 similar to those described in the preceding embodiments. The PCB 916 is attached via screws 914 to the inner surface of the base 908, which is preferably formed from brass or a similar heat-conducting metal. Ribs 904 formed in the base serve as heat sinks. A shroud 902, preferably formed from copper, brass, stainless steel or other coated or treated metal, hangs down from base 908 and is secured in place by set screw 906. A ring 910, preferably formed from the same material as the base, extends from the top of base 908 to provide means for hanging the fixture from a structure, tree limb or other appropriate support.

Figure 16:
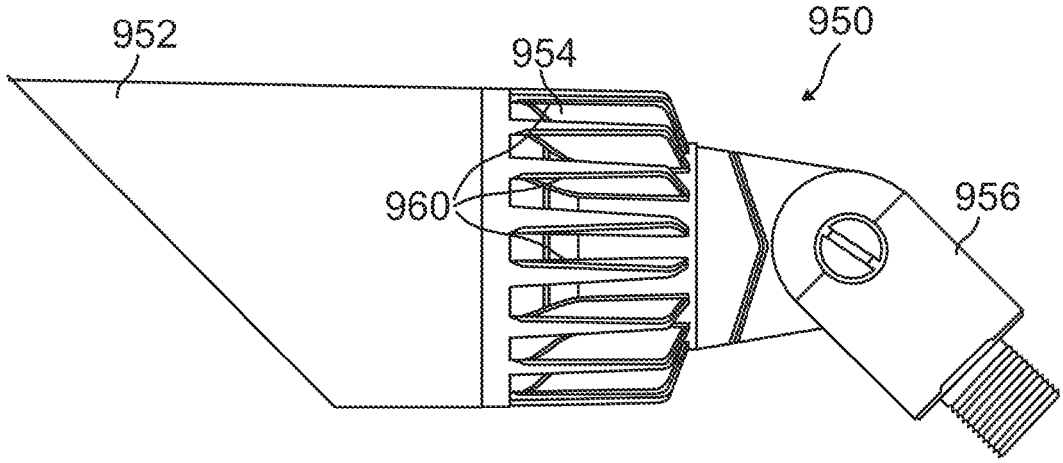
FIG. 16 is a side view of an alternative embodiment of a spot light fixture with an integrated heat sink.
Figure 17:
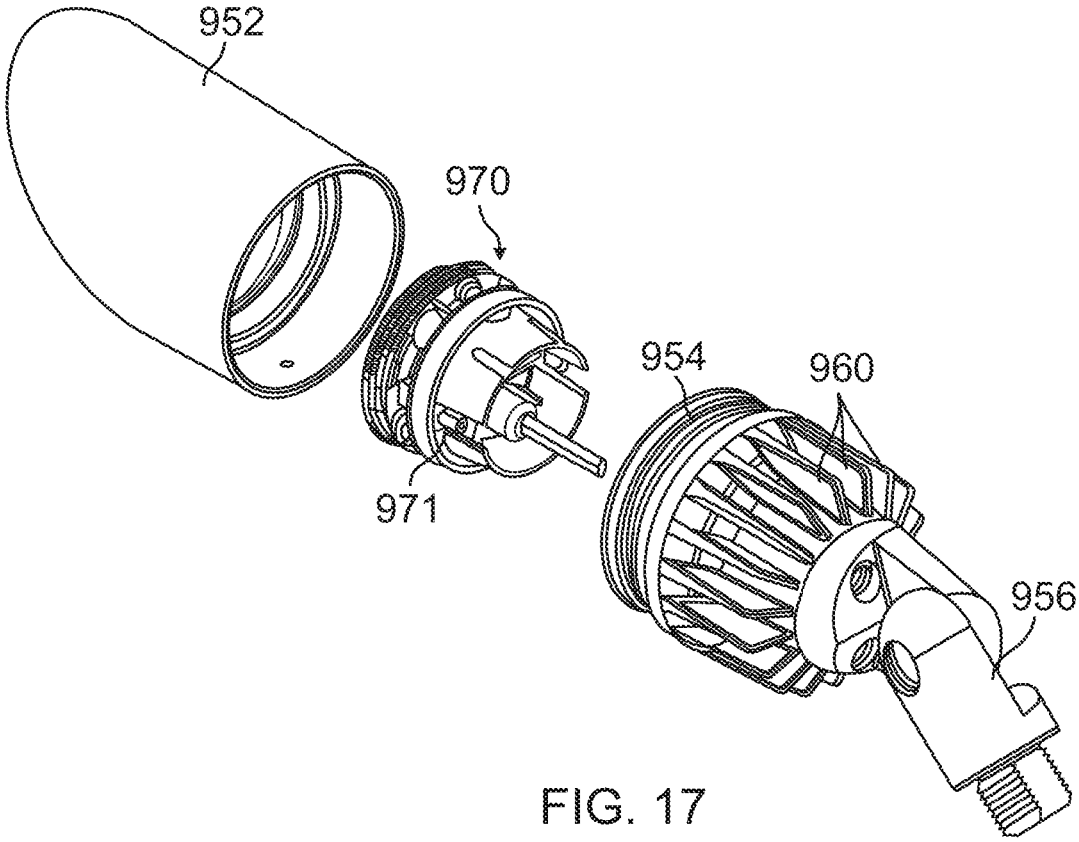
FIG. 17 is a partially exploded perspective view of the fixture of FIG. 16.
Figure 18:
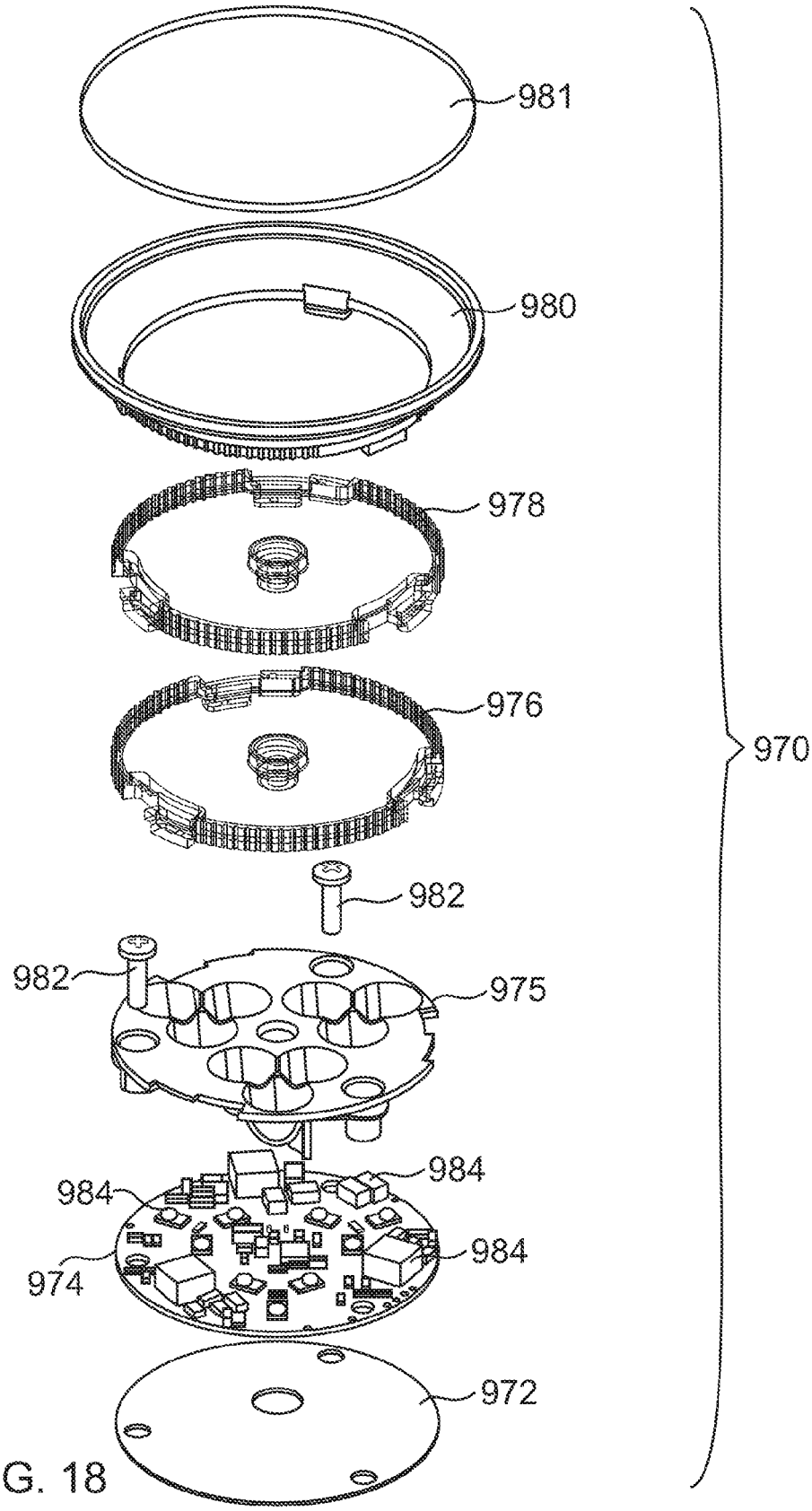
FIG. 18 is an exploded perspective view of a LED light module according to the present invention.
Figure 19:
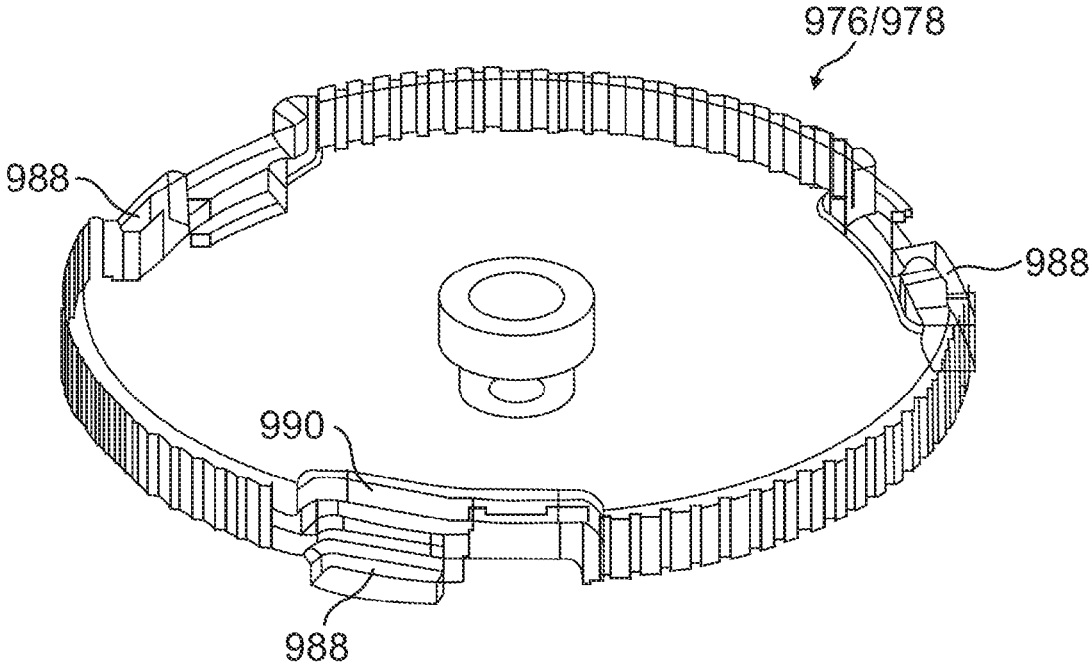
FIG. 19 is a perspective view of an optical element of the LED light module of FIG. 18.

FIGS. 16 and 17 illustrate a spot light fixture 950 with enhanced thermal management function and which incorporates a lighting module that provides increased versatility in light manipulation. As shown in FIG. 16, the fixture 950 includes a shroud 952, a base 954 with radially-extending ribs 960 for improved heat dissipation due to their size (compared with prior embodiments), and a mounting/support means 956, which in this case, is a knuckle joint. The construction of the fixture is shown in FIG. 17. In particular, light module 970 is enclosed within the assembled shroud 952 and base 954. In one embodiment, the bottom surface of light module 970 is mounted directly onto a flat surface at the bottom of a cavity within base 954, in the same manner as the embodiments of FIGS. 14 and 15. In an alternative embodiment, an optional generally cylindrical heat sink 971 may be attached to the bottom of light module 970 and inserted into the base cavity to provide increased surface area in the form of the cylindrical fins for thermal conduction to the interior sidewall of base 954. In this embodiment, thermal grease may be used to further enhance conduction.

The details of light module 970 are illustrated in FIGS. 18-21. Light module 970 is an assembly of six to eight individual components consisting of thermal conductor mount 972, LED-driver board 974, parabolic reflector array 975, diffuser 976 and/or one or more filters 978, and, optionally, adaptor ring 980 and diffuser window 981. Reflector array 975, LED-driver board 974 and thermal conductor mount 972 are attached to the inner surface of base 954 of the fixture using mounting hardware 982. In a preferred embodiment, the disk-shaped thermal conductor mount 972 is faced on one or both sides with a double-sided adhesive coating to provide easy attachment to the bottom of LED-driver board 974 and/or to the inner support surface of the fixture base, e.g., base 954 of FIG. 17. As illustrated, mounting hardware 982 consists of three screws which are inserted through openings in each of the reflector array, PCB and thermal conductor mount 972 to be screwed into corresponding threaded bores formed in the interior of base 954. More or fewer fasteners may be used if appropriate. It may be desirable to utilize captive screws with their shells affixed in the reflector array 975 to prevent loss of the screw and to facilitate installation and removal.

Figure 20:
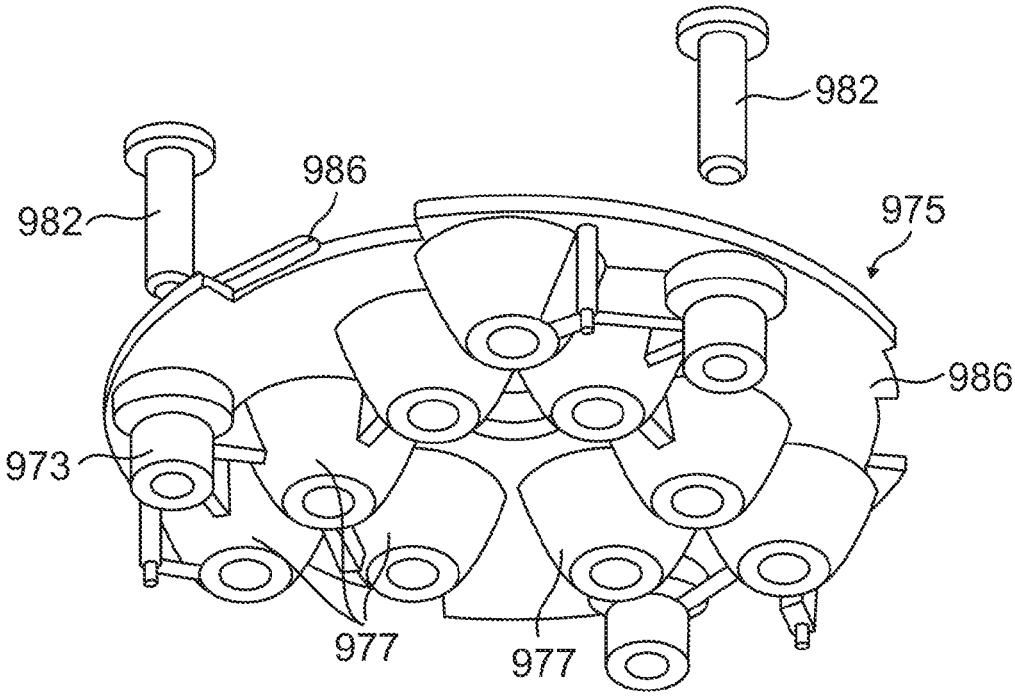
FIG. 20 is a perspective view of a reflector assembly of LED light module of FIG. 18.
Figure 21:
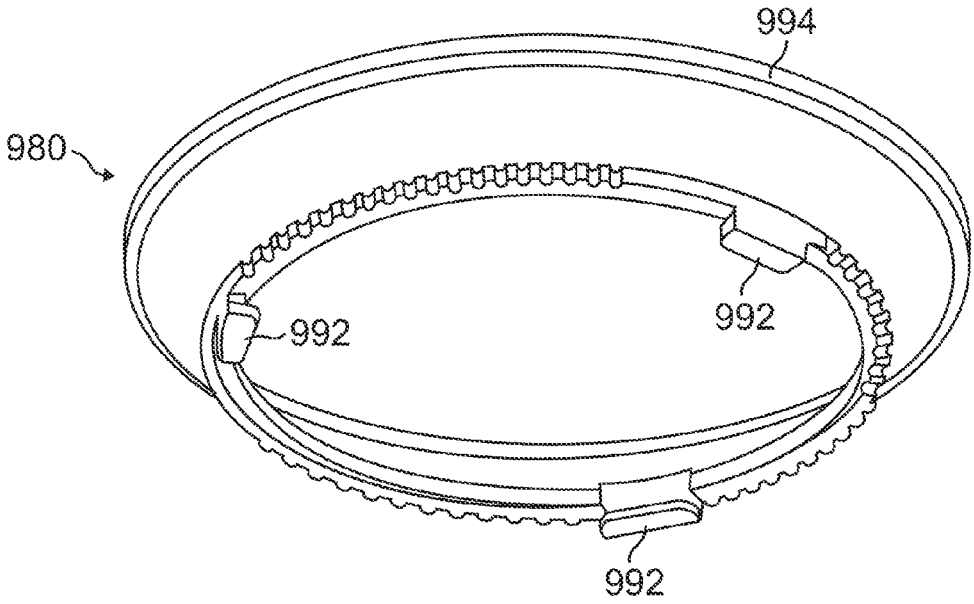
FIG. 21 is a perspective view of an adapter ring of the LED light module of FIG. 18.
Figure 22:
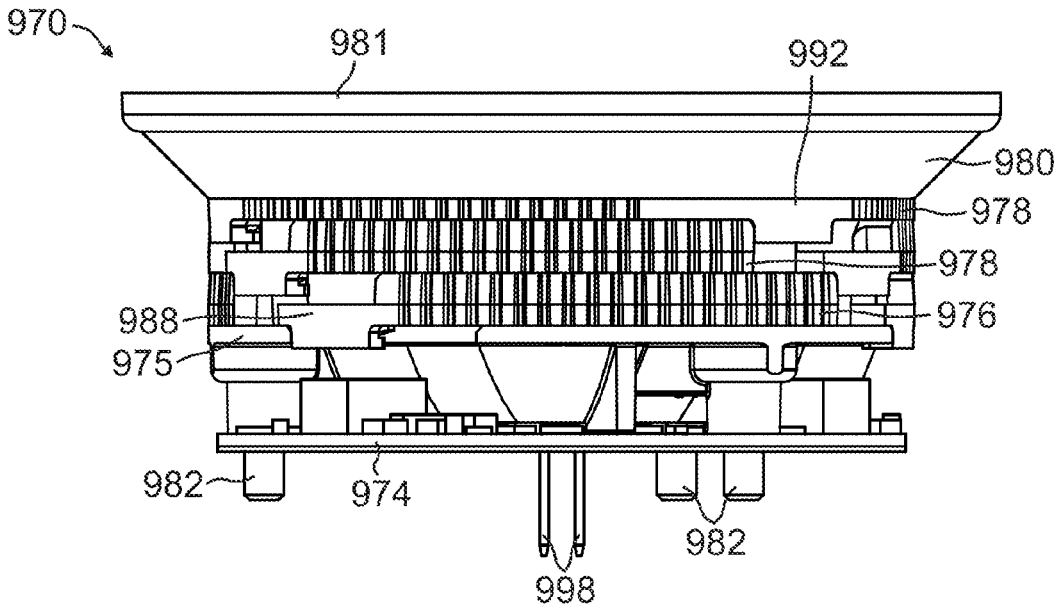
FIG. 22 is a side view of an assembled LED light module of FIG. 18.

Additional details of the construction of reflector array 975 can be seen in FIG. 20. The array illustrated is configured for a nine LED assembly 974 with nine individual parabolic reflectors 977 integrally molded in the array at locations to correspond to the layout of the LEDs 984 on the LED board 974. Bosses 973 receive the mounting hardware 982 and provide a fixed spacing between the array 975 and the LED board 974. As will be readily apparent to those in the art, more or fewer LEDs may be used, with the configuration of the reflector array adapted to the appropriate number of LED elements on the LED board 974. A male latch 986 is formed at uniformly spaced positions around the outer edge of the reflector array 975. The male latch 986 is one half of a bayonet-style fastener which mates with a female latch 988 that extends from the bottom of whichever of diffuser 976 and/or filter 978 (collectively referred to as optical elements) is intended to directly abut the top of reflector array 975. Bayonet fasteners or connectors, which are well known in the art, include a male side with one or more pins or tabs, and a female receptor with matching "L" slots to keep the two parts locked together. Note that in the present description, although both parts of the bayonet fastener are referred to as "latches", it should be understood that the female latch corresponds to the slot and the male latch corresponds to the pin or tab. For attachment, the male and female latches (bayonet fasteners) are aligned and the two optical elements are pressed together, after which one of the diffuser or filter and the reflector array is rotated to engage the two components in a bayonet mount. As illustrated, each component has three latches spaced equally around the outer edges of the component, e.g., at 120°, but any appropriate number of latches may be used, for example, from one to four latches would be practical for use in the present invention. More may be used, but would not measurably improve the stability of the assembly. In the exemplary embodiment, the optical elements (diffuser and filters) each have a male latch 990 at the edges of their top surfaces and a female latch 988 at their bottom surfaces, allowing multiple filters to be stacked together and firmly but releasably secured by aligning the latches and rotating the two components to engage the corresponding latches. Typically, a quarter turn or less will be sufficient to engage the latches. With each diffuser and filter configured in the same manner, a virtually unlimited number of combinations of filter and window options are possible. Optional adapter ring 980 has female latches 992 extending downward from its lower edge for mating with the male latches 986 at the top of diffuser 976 or filter 978. The adapter ring 980 is securely but releasably fastened to the uppermost filter or diffuser, thus providing a module with robust construction that may be used for installation in a new low voltage or solar operation or as a replacement for existing incandescent or halogen bulbs. It should be noted that while the latches are described as being male at the top and female at the bottom of each component, the arrangement may be reversed, e.g., female latch on top, male latch at the bottom, as long as the relative order of the latches remains that same for all components in the stack to allow adjacent components to be secured. A two pin connector 998 extending from the bottom of the LED/driver board (in the same configuration as in previously-described embodiments) provides for connection of the lighting module to a two pin socket such as those used for conventional halogen bulbs.

The upper edge of adapter ring 980 has a lip 994 configured for receiving a glass or plastic window 981, which snaps into the lip 994 to be secured in place at the top of the stack of components that form the module. The window 981 may be a clear lens, may be frosted to reduce glare, i.e., a diffuser, or may be colored to create additional effects. Other modifications will be readily apparent to those of skill in the art.

In an alternative embodiment, the adapter ring and window may be replaced with a right angle reflector such as that shown in the embodiment of FIG. 9 for use in path lights and other fixtures in which radial light emission is appropriate. The reflector may be attached in a manner similar to that described above, by way of legs and mounting pins inserted through corresponding openings (not shown) in the optical elements. Preferably, however, similar bayonet fasteners can be formed in an annular base to which the pins extending downward from reflector are attached. As above, the legs serve as spacers that ensure correct separation between the optical element and the reflector surface. However, unlike the prior embodiment, the annular base provides the means for connection of the right angle reflector to the element immediately below. It should be noted that incorporation of the bayonet fastener in an annular base of the right angle reflector would permit direct attachment of the right angle reflector to the top of the reflector array 975 if no optical elements are to be used.

Figure 23A:
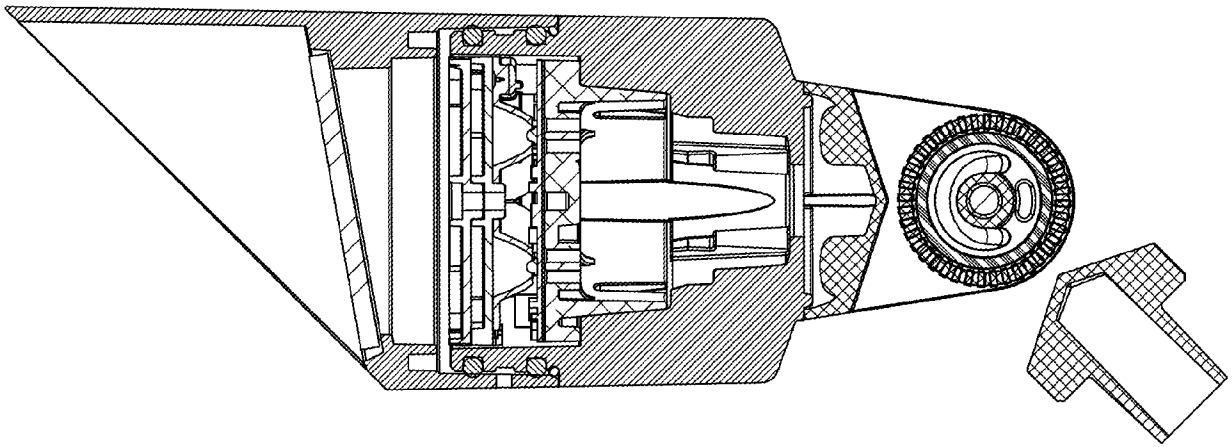
FIGS. 23A and 23B illustrate an exemplary spot light fixture with the inventive LED light module and a conventional halogen light source, respectively.
Figure 23B:
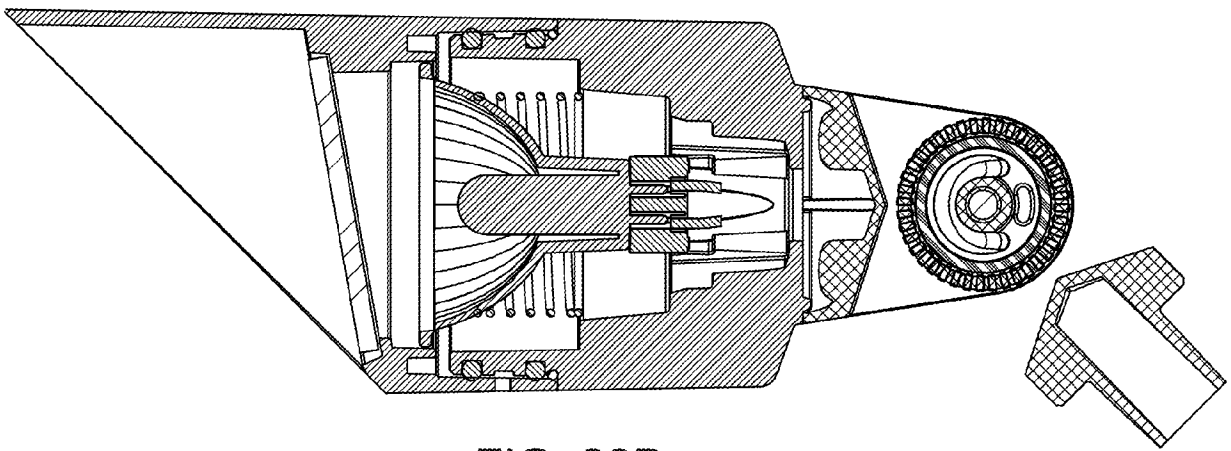

The lighting module described above provides a versatile, robust device for increasing the options for use of LED light sources in lighting fixtures. The use of a standard two pin connector allows the lighting module to be retrofitted into existing lighting systems that are configured for halogen or incandescent bulbs, providing a more energy efficient lighting system. FIGS. 23A and 23B illustrate how the same spot fixture can use either a conventional halogen lamp light source or a LED light module as described above. The same LED light module may be utilized in new fixtures specifically designed for use with such light sources. Preferably, for thermal management, the fixture should include a heat dissipation mechanism such as the radiating fins shown in the embodiments of FIGS. 2 and 14-17.

The foregoing detailed description of preferred embodiments is not intended to limit the invention to the specific details disclosed herein. Rather, the present invention extends to all functionally equivalent structures, methods and uses as fall within the scope of the appended claims.

What is claimed is:

1. A light module for a lighting fixture having a base with an interior cavity, comprising:

a printed circuit board dimensioned to be received within the interior cavity of the base, the printed circuit board having an upper surface and a lower surface;

one or more LED elements mounted on the upper surface of the printed circuit board;

one or more LED drivers mounted on the printed circuit board in electrical communication with the LED elements;

an electrical connector extending from the lower surface of the printed circuit board for attachment to an electrical socket within the fixture;

a thermal conductor in thermal contact with the printed circuit board;

a reflector assembly comprising an upper surface and at least one parabolic reflector extending downward from the upper surface at a position corresponding to a position of an LED element of the one or more LED elements;

a first set of fasteners for releasably attaching each of the printed circuit board, the thermal conductor and the reflector assembly to a support surface within the interior cavity of the base;

at least one optical element releasably mounted on top of the reflector, the at least one optical element having an edge; and a second set of fasteners extending from the upper surface of the reflector assembly for releasably mating with corresponding connectors extending from the edge of the at least one optical element.

2. The light module of claim 1, wherein the one or more LED elements comprises a plurality of LED elements and wherein the at least one parabolic reflector comprises a reflector array of individual parabolic reflectors.

3. The light module of claim 1, wherein the second set of fasteners comprises a plurality of latches.

4. The light module of claim 3, wherein the corresponding connectors comprise pins extending radially from the edge of the at least one optical element, wherein the pins fit into notches in the latches.

5. The light module of claim 3, wherein the plurality of latches and corresponding connectors comprise bayonet fasteners that are releasably attached by rotating one of the reflector array and the at least one at least optical element relative to the other.

6. The light module of claim 3, wherein the at least one optical element comprises a stack of two or more optical elements, wherein each optical element has latches formed around its edge for releasably mating with corresponding latches of an abutting optical element.

7. The light module of claim 6, wherein the latches and corresponding latches comprise bayonet fasteners.

8. The light module of claim 1, further comprising:

an adapter ring releasably attached on top of the at least one optical element; and a window retained within an upper portion of the adapter ring.

9. The light module of claim 8, wherein the adapter ring has bayonet fasteners that mate with bayonet fasteners on one of the reflector assembly and the at least one optical element.

10. The light module of claim 1, wherein the base comprises a heat dissipation means.

11. The light module of claim 1, wherein the thermal conductor comprises a disk.

12. A light module for a lighting fixture having a base including an interior cavity, the light module comprising:

a printed circuit board releasably retained within the interior cavity of the base, the printed circuit board having an top surface and a bottom surface;

an electrical connector extending from the bottom surface of the printed circuit board for attachment to an electrical socket within the base;

one or more LED elements and one or more LED driver mounted on the printed circuit board, the LED elements and LED driver in electrical communication with the electrical connector;

a thermal conductor in thermal contact with each of the printed circuit board and at least one inner surface of the interior cavity of the base;

a light-directing assembly disposed above each of the one or more LED elements, the light-directing assembly comprising an upper surface and at least one light-directing element extending downward from the upper surface;

a first set of fasteners for releasably attaching each of the printed circuit board, the thermal conductor and the light-directing assembly to a support surface within the interior cavity of the base;

at least one optical element releasably disposed on top of the light-directing assembly; and a second set of fasteners extending from the upper surface of the light-directing assembly for releasably mating with corresponding connectors extending from an edge of the at least one optical element.

13. The light module of claim 12, wherein the at least one light-directing element is a parabolic reflector.

14. The light module of claim 13, wherein the at least one light-directing element is a plurality of individual parabolic reflectors integrally formed into a reflector array configured to match a layout of the one or more the LED elements.

15. The light module of claim 12, wherein the second set of fasteners comprises a plurality of latches.

16. The light module of claim 15, wherein the corresponding connectors comprise pins extending radially from the edge of the at least one optical element, wherein the pins fit into notches in the latches.

17. The light module of claim 15, wherein the plurality of latches and corresponding connectors comprise bayonet fasteners.

18. The light module of claim 17, wherein the at least one optical element comprises a stack of two or more optical elements, wherein each optical element has latches formed around its edge for releasably mating with corresponding connectors of an abutting optical element.

19. The light module of claim 15, further comprising:

an adapter ring releasably attached on top of the at least one optical element; and a window retained within an upper portion of the adapter ring.

20. The light module of claim 19, wherein the adapter ring has bayonet fasteners that mate with bayonet fasteners on the at least one optical element.

21. The light module of claim 12, wherein the thermal conductor comprises a disk.

22. A light module for a lighting fixture having a lamp support base for retaining an electrical socket, the light module comprising:

a printed circuit board releasably attached to the lamp support base, the printed circuit board having an top surface and a bottom surface;

an electrical connector extending from the bottom surface of the printed circuit board for connection to the electrical socket;

LED elements and at least one LED driver mounted on the printed circuit board, the LED elements and the at least one LED driver in electrical communication with the electrical connector;

a thermal conductor in thermal contact with each of the printed circuit board and the lamp support base;

a light-directing element array disposed above the LED elements, the array having a planar top surface and a light-directing element corresponding to each LED element extending downward from the planar top surface;

a first set of fasteners for releasably attaching each of the printed circuit board, the thermal conductor and the light-directing element array to a support surface within an interior cavity of the lamp support base;

at least one optical element releasably disposed on top of the light-directing element array; and a second set of fasteners extending from the upper surface of the light-directing element array for releasably mating with corresponding fasteners extending from an edge of the at least one optical element.

23. The light module of claim 22, wherein the light-directing element is a parabolic reflector.

24. The light module of claim 22, wherein the second set of fasteners comprises a plurality of latches.

25. The light module of claim 24, wherein the corresponding connectors comprise pins extending radially from the edge of the at least one optical element, wherein the pins fit into notches in the latches.

26. The light module of claim 24, wherein the plurality of latches and corresponding connectors comprise bayonet fasteners.

27. The light module of claim 24, wherein the at least one optical element comprises a stack of two or more optical elements, wherein each optical element has latches formed around its edge for releasably mating with corresponding connectors of an abutting optical element.

28. The light module of claim 24, further comprising:

an adapter ring releasably attached on top of the at least one optical element; and a window retained within an upper portion of the adapter ring.

29. The light module of claim 28, wherein the adapter ring has bayonet fasteners that mate with bayonet fasteners on the at least one optical element.

* * * * *